US007473211B2

(12) United States Patent
Lee

(10) Patent No.: US 7,473,211 B2
(45) Date of Patent: Jan. 6, 2009

(54) DEVICE FOR CONTROLLING WEIGHT OF A WEIGHT TRAINING MACHINE AND ITS METHOD

(76) Inventor: Byung-don Lee, 12-96 Kalhyun-dong, Eunpyung-ku, Seoul (KR) 122-800

( * ) Notice: Subject to any disclaimer, the term of this patent is extended or adjusted under 35 U.S.C. 154(b) by 601 days.

(21) Appl. No.: 10/502,168

(22) PCT Filed: Nov. 22, 2002

(86) PCT No.: PCT/KR02/02184

§ 371 (c)(1),
(2), (4) Date: Aug. 17, 2004

(87) PCT Pub. No.: WO03/105968

PCT Pub. Date: Dec. 24, 2003

(65) Prior Publication Data

US 2005/0143228 A1 Jun. 30, 2005

(30) Foreign Application Priority Data

Jan. 28, 2002 (KR) ..... 10-2002-0004744
Jan. 28, 2002 (KR) ..... 10-2002-0004746
Nov. 12, 2002 (KR) ..... 10-2002-0069921
Nov. 12, 2002 (KR) ..... 10-2002-069926

(51) Int. Cl.
*A63B 21/08* (2006.01)
*A63B 21/06* (2006.01)
*A63B 21/062* (2006.01)

(52) U.S. Cl. ..... 482/97; 482/94; 482/98

(58) Field of Classification Search ..... 482/93–103, 482/135–138

See application file for complete search history.

(56) References Cited

U.S. PATENT DOCUMENTS 4,546,971 A 10/1985 Raasoch
4,746,113 A 5/1988 Kissel
5,037,089 A 8/1991 Spagnuolo
5,350,344 A * 9/1994 Kissel ..... 482/98
5,655,997 A * 8/1997 Greenberg et al. ..... 482/5
6,174,265 B1 * 1/2001 Alessandri ..... 482/5
7,252,627 B2 * 8/2007 Carter ..... 482/98

* cited by examiner

*Primary Examiner*—Fenn C Mathew
(74) *Attorney, Agent, or Firm*—Jordan and Hamburg LLP

(57) ABSTRACT

The present invention relates to a device for controlling the weight of a weight training machine and its method which is capable of allowing a user of the weight training machine to control weight of a stack more conveniently, eliminating any inconvenience caused when a fixing pin is inserted into a hole of the stack, which is a weight unit of the conventional weight training machine, preventing the fixing pin from escaping out of the stack during the weight training by the user of the weight training machine so that any safety accident can be kept previously from occurring, allowing the user to control minutely weight for the weight training, being programmable by means of remote electrical control so as to bring about a motive for exercise, and eliminating any restriction of design, which is common in the prior art because of the fixing pin.

17 Claims, 38 Drawing Sheets

PRIOR ART

PRIOR ART

DEVICE FOR CONTROLLING WEIGHT OF A WEIGHT TRAINING MACHINE AND ITS METHOD

TECHNICAL FIELD

The present invention relates generally to a device for controlling weight of a weight training machine and its method, and more particularly to a device for controlling weight of a weight training machine and its method which is capable of allowing a user of the weight training machine to control weight of a stack more conveniently, eliminating any inconvenience caused when a fixing pin is inserted into a hole of the stack, which is a weight unit of the conventional weight training machine, preventing the fixing pin from escaping out of the stack during the weight training by the user of the weight training machine so that any safety accident can be kept previously from occurring, allowing the user to control minutely weight for the weight training, being programmable by means of remote electrical control so as to bring about a motive for exercise, and eliminating any restriction of design, which is common in the prior art because of the fixing pin.

BACKGROUND ART

Generally, a weight training machine is the one that allows an exerciser to train his or her muscles by connecting a stack of weight he or she wants to train to a wire having a handle attached thereto and pulling the handle so that the stack can be moved upward.

Such a weight training machine is shown in FIGS. 1 and 2. As shown in the drawings, above a supporting stand 1 having a base 1*a* is mounted a pulley 2, and a wire 3, to which a plate 4 is connected, runs on the pulley 2. The plate 4 is provided at the central lower part thereof with a fixing bar 5 with a plurality of holes formed. The supporting stand 1 is provided at the central part thereof with a pair of guides 6 in such a manner that the plate 4 can be moved up and down along the guides 6. To the guides 6 are attached movably up and down a plurality of stacks 7 each having a hole into which the fixing bar is inserted. Each of the stacks is provided at the side thereof with a hole corresponding to the hole of the fixing bar 5.

In this conventional weight training machine, the fixing bar 5 attached to the lower part of the plate 4 is inserted vertically through the hole formed in the central part of the stack, and then a fixing member 8 is inserted through the hole formed in the target stack 7 so that the fixing bar 5 can be linked to the desired weight, to connect the fixing bar 5 to the stack 7. Consequently, the weight of the weight training machine is adjustable.

Approximately twenty kinds of weight training machines that help an exerciser train his or her muscles by his or her muscle parts of the body commonly have such a device for controlling weight. However, the device for controlling weight has a complex mechanical structure depending on a property of each of the weight training machine, which results in the following inconveniences and restrictive factors.

I) When adjustment of weight of the weight training machine is required, an exerciser must bend his or her back and move his or her body to the left or the right to have access to a fixing member so that the fixing member can be disengaged, and after the desired weight has been chosen, the fixing member must be inserted again. In this case, however, not only the access to the fixing member itself is inconvenient, but also it is very difficult and inconvenient to find a very small hole of the stack to be selected and insert the fixing member into the hole after the fixing member has been accessed. Especially, it is very hard and difficult for a rehabilitant with weak and discomfort constitution to control weight of the weight training machine without help of an assistant.

II) The posture as mentioned in the aforesaid paragraph I) must be taken in order to confirm the weight currently loaded, which is very inconvenient.

III) The conventional fixing member having no locking unit may be disengaged from the stack during the weight training. At this time, no load is hanging on the handle, by which the exerciser may fall down on his or her back from the chair or the heavy handle may strike him or her on the head or the face with a result that various kinds of safety accidents may occur.

IV) The training is maintained only by the fixed weight during the weight training, which makes the exerciser feel bored, with the result that better effect of the training can not be expected.

V) The part of the device for controlling weight must be formed with the open structure. As a result, a design of the device for controlling weight is severely restricted in case that any cover is attached to the stack part.

VI) Since the stack has the structure that the fixing pin is inserted into the hole of the stack, thickness of the stack must be approximately 3 cm, which increases the weight of the unit stack to 5 kg. As a result, the weight of the weight training machine must be increased or decreased by the unit of 5 kg, which have the exerciser hold the weight of 5 kg or 10 kg by force in case that the suitable training weight of the exerciser is in the range between 5 and 10 kg.

DISCLOSURE OF INVENTION

The present invention is disclosed in order to overcome the aforesaid drawbacks of the prior art.

It is an object of the present invention to provide a device for controlling weight of a weight training machine and its method which is capable of allowing a user of the weight training machine to confirm and control weight of a stack easily, maintaining stably a connection state between a stack and a fixing bar by a fixing unit so that any safety accident can be kept previously from occurring, controlling automatically the amount of load and having several various programs built-in so that interest of the user can be brought about and thus a motive of the training can be brought about, allowing different users, such as physically handicapped persons or rehabilitants, who need to train with help of assistants, to use the weight training machine more conveniently, making more advanced design possible, and adjusting minutely weight of the weight training machine.

In order to accomplish the aforesaid object of the present invention, a) there is provided a device for controlling weight of a weight training machine, said weight training machine comprising a plurality of stacks attached slidably upward or downward to a pair of guides mounted between a support stand, which is attached to a base, a plate mounted slidably to said guides in such a manner that it is placed at the upper part of the stack, and a fixing bar with a plurality of holes formed therein, said fixing bar being mounted to the lower part of said plate, wherein each of said stacks is formed in the shape of a brick with a depressed side, at the side of the depressed part of said stack is formed an insert hole, at one end of said plate is formed guides, said guides being placed in the depressed part of the stack, said guide is provided at the one side thereof with a plurality of stop grooves along its longitudinal direction, and to said guide is mounted a fixing unit, said fixing unit comprising a body having a receiving chamber passing through laterally at the center thereof; a spring mounted in said receiving chamber of said body; a fixing pin supported by means of said spring and having a handle provided at one end thereof; and positioning means, said positioning means comprising a ball inserted into a hole formed on the side of said body, a spring mounted to one side of said ball, and a mood bolt for preventing disengagement of said spring, b) there is provided a device for controlling weight of a weight training machine, said weight training machine comprising a plurality of stacks attached slidably upward or downward to a pair of guides mounted between a support stand, which is attached to a base, and a plate mounted slidably to said guides in such a manner that it is placed at the upper part of the stack, wherein each of said stacks is formed in the shape of a brick with a depressed side, at the side of the depressed part of said stack is formed an insert hole, and to one side of said plate is attached a fixing unit, said fixing unit comprising a fixing unit body of hollow rectangular shape; a latching member having a plurality of hooks formed inside said fixing unit body in the longitudinal direction; a spring arranged at the lower part of said latching member, a plurality of fixing pins going through said fixing unit body and having a button formed at one end thereof; and a spring arranged between the said button and the outside of said fixing unit body, said fixing unit being placed in the depressed part of said stack, c) there is provided a device for controlling weight of a weight training machine, said weight training machine including a plurality of stacks, each of which is formed in the shape of a brick with a depressed side, an insert hole formed in each of the stacks, a fixing unit of rectangular shape attached to the front part of the stacks, and a fixing plate provided in said fixing unit, said fixing plate being inserted selectively into said insert hole for an exerciser to lift up stacks of the desired weight, said device for controlling weight comprising a safety unit and a disengagement preventing unit with a seesaw part, wherein a push pin and a latching pin are placed at right angle to each other to the both sides of the rear part of said fixing plate, a rotating bar with a pushing plate is provided close to said push pin, a support bar placed at the bottom surface of the lowest stack is attached to the lower end of said rotating bar, load of all the weights of said stacks is applied to said safety unit when the fixing plate is disengaged from said insert hole of said stack, and wherein to a front plate of said fixing unit coming into close contact with a latching pin is attached upper and lower hook plates for fixing said latching pin to a latching portion by means of upper and lower hooks, ratio of the actuating distance of said upper hook to said lower hook being 1:2, d) there is provided a device for controlling weight of a weight training machine, said weight training machine including a plurality of stacks, each of which is formed in the shape of a brick with a depressed side, an insert hole formed in each of the stacks, a fixing unit of rectangular shape attached to the front part of the stacks, and a fixing plate provided in said fixing unit, said fixing plate being inserted selectively into said insert hole for an exerciser to lift up stacks of the desired weight, wherein stacks each having an insert hole of rectangular shape at the bottom surface under the center of gravity thereof are provided, a fixing plate is provided, said fixing plate having a stationary part formed of the same sheet shape as said insert hole, rectangular grooves being formed at the both sides of the rear part thereof, an actuating part with a sloping portion formed at the both ends of the rear part thereof, guides, by which a disengagement preventing plate inserted into a groove appears or disappears, are attached to side plate of a fixing unit, at the front of said disengagement preventing plate facing said groove is formed a sloping portion opposite to the sloping portion of an actuating part, a spring is arranged at the opposite side thereof in a disengagement preventing unit, thereby said disengagement preventing plate being latched to said actuating part of the fixing unit to prevent said fixing plate from escaping out of said insert hole when said fixing plate is inserted into said insert hole of said stack, e) there is provided a device for controlling weight of a weight training machine, said weight training machine comprising stacks and guides, said stacks being attached movably up and down to said guides, a base, said guides being supported fixedly to the upper part of said base, a frame for fixing the upper part of said base and the upper part of said guides, a plurality of said stacks for controlling weight being attached movably up and down to said guides, wherein a sensor is attached at one inner side of said frame, to said guide is attached movably up and down an electromagnet with a fixing member, to which a wire is connected at the upper part of said stack, at regular spacing, said electromagnet is connected to a power controller for controlling the strength of the magnetic force of said electromagnet via a power input line to supply electric power, said power controller is connected to a controller for controlling said power controller, said controller including a display part for displaying messages such as warning, weight of the stack, and the number of movement, and f) there is provided a method for controlling weight of a weight training machine, comprising the steps of: checking whether electric power is supplied through a controller while the electric power is supplied to a weight control device; charging and informing that the electric power is not applied if the electric power is off or the electric power is not applied to an electromagnet; adjusting load of stacks if the electric power is applied normally to the electromagnet; checking if the electric power is applied to said electromagnet; comparing the value of the load set by the user with the value of the weight of said stacks attached by means of said electromagnet if the electric power is applied normally to said electromagnet; raising strength of magnetic force of said electromagnet if the measured value is lower than the set value; lowering strength of magnetic force of said electromagnet if the measured value is higher than the set value; holding strength of magnetic force of said electromagnet if the set value and the measured value is the same; and informing a user that it is ready for using said machine.

BRIEF DESCRIPTION OF THE DRAWINGS

The preferred embodiments of the present invention will hereinafter be described in conjunction with the accompanying drawings in which:

FIG. 36*a* is a sectional plan view of a fixing unit according to the present invention, showing a state that it is inserted into an insert hole of a stack;

BEST MODE FOR CARRYING OUT THE INVENTION

Preferred embodiments of the present invention will now be described in detail with reference to the accompanying drawings.

Figure 1:
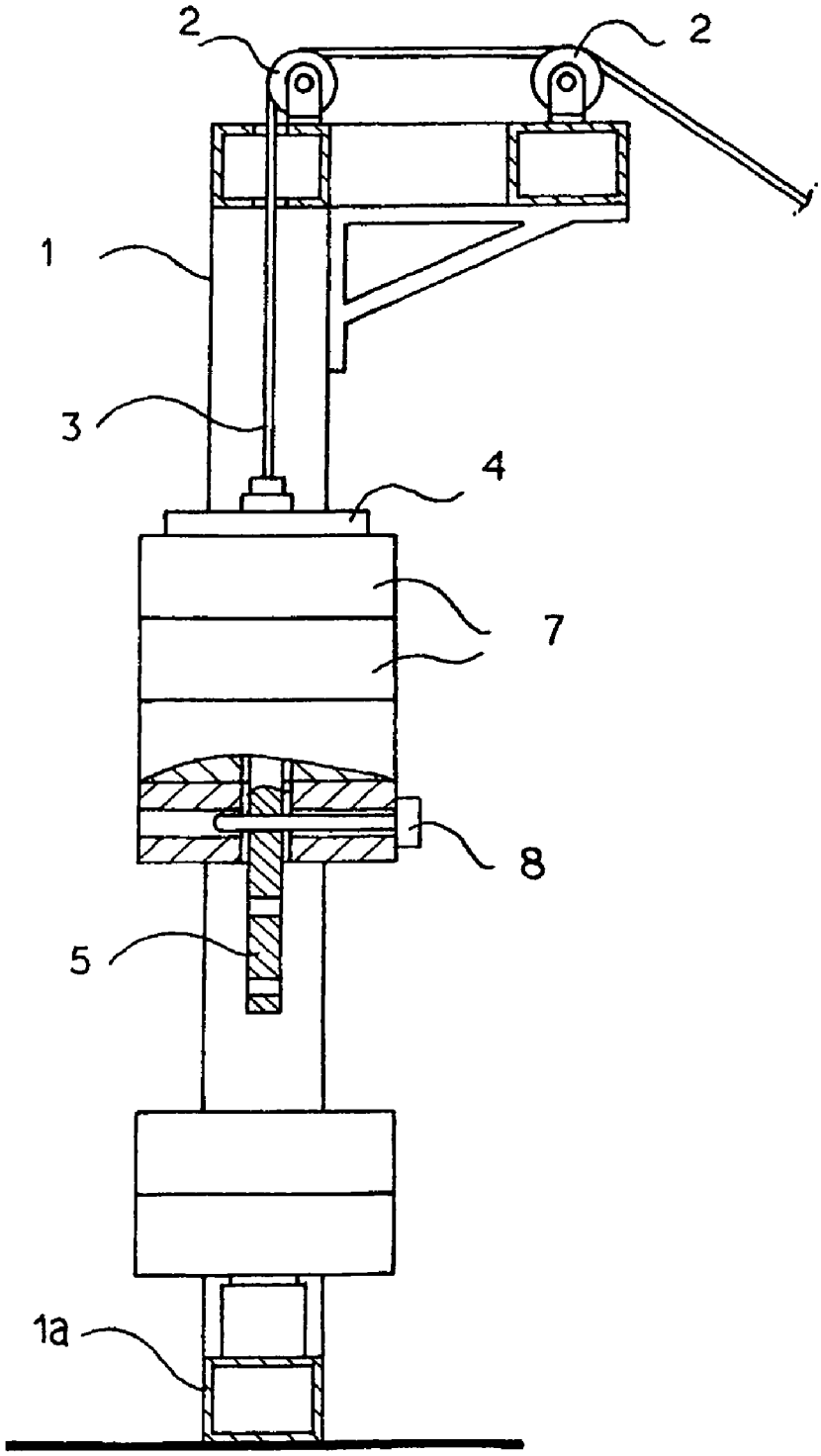
FIG. 1 is a side elevational view, partly broken away, of a weight training machine of the prior art.
Figure 2:
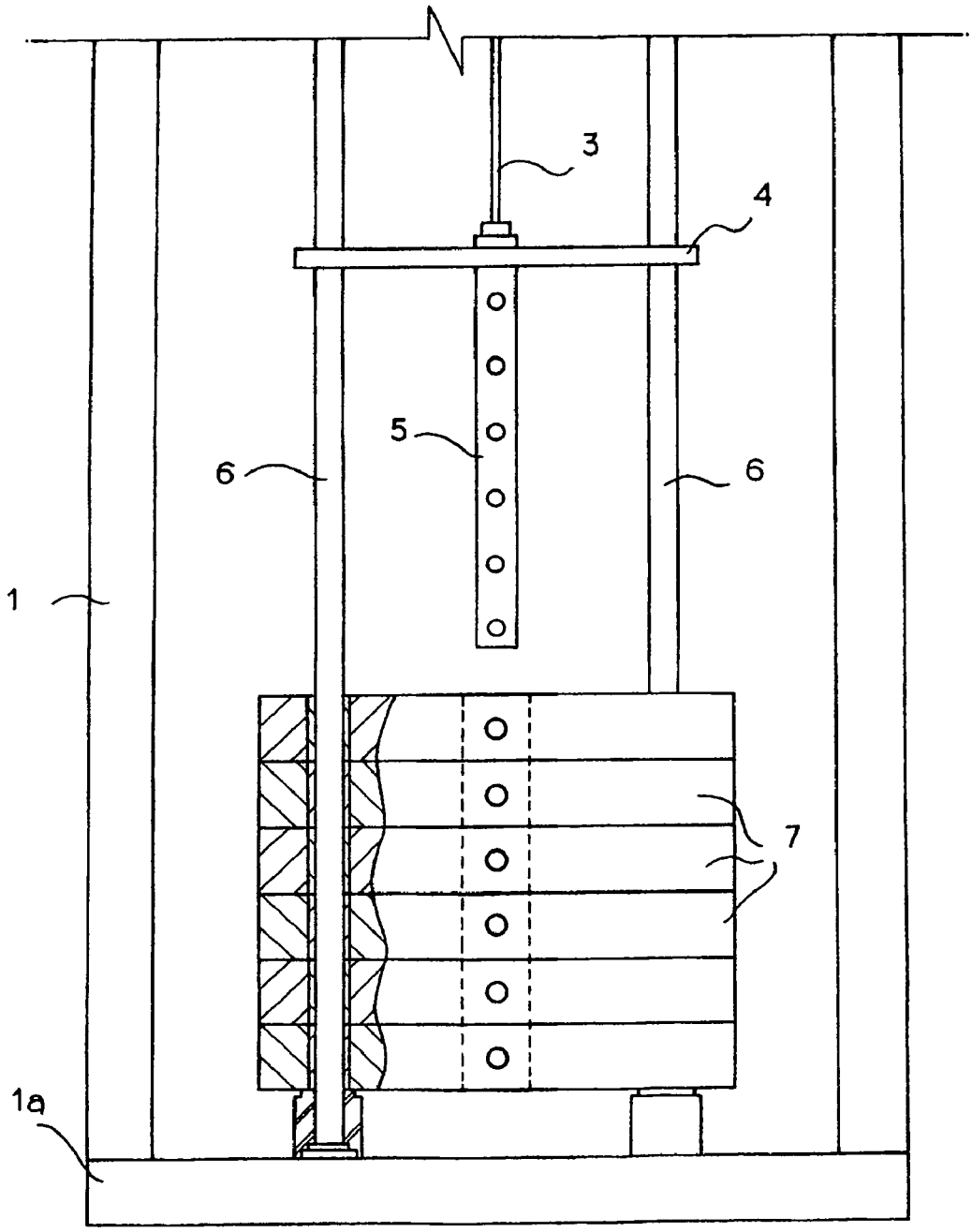
FIG. 2 is a front elevational view, partly broken away, of a weight training machine of the prior art.
Figure 3:
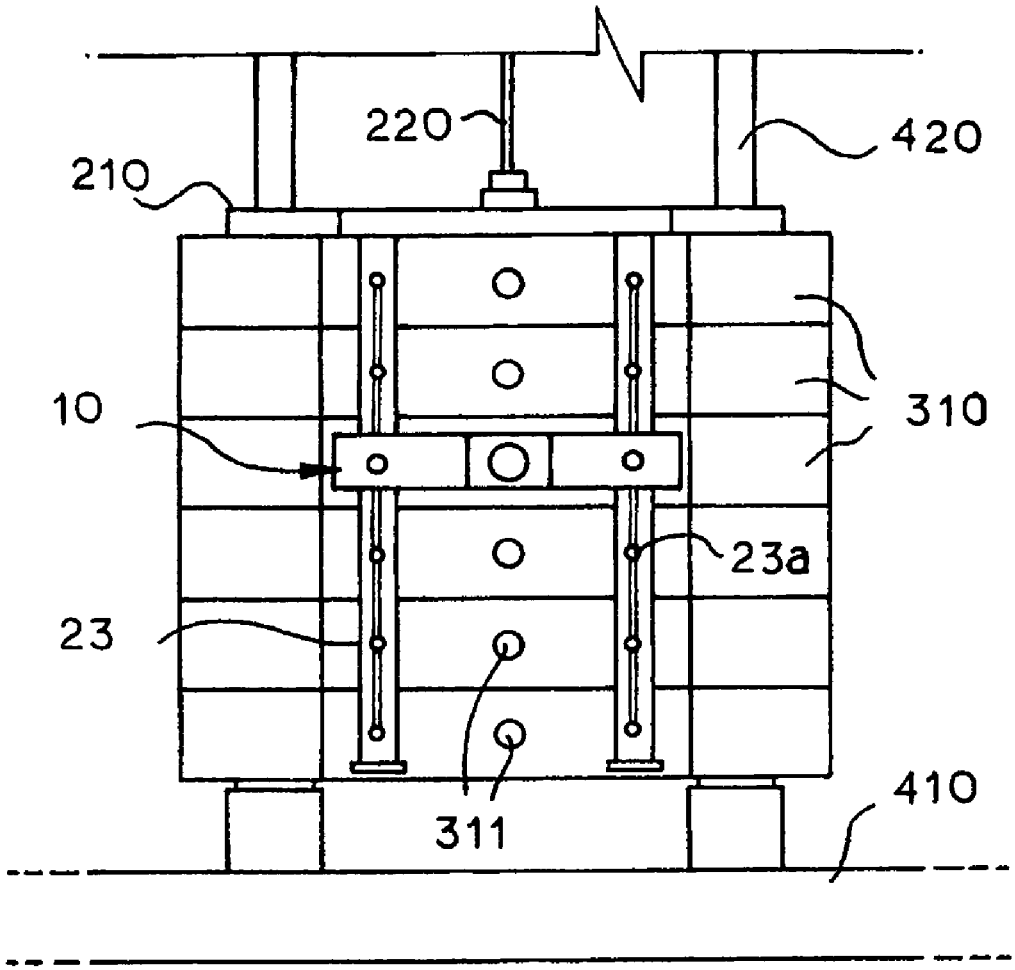
FIG. 3 is a front elevational view of a weight training machine according to the present invention.
Figure 4:
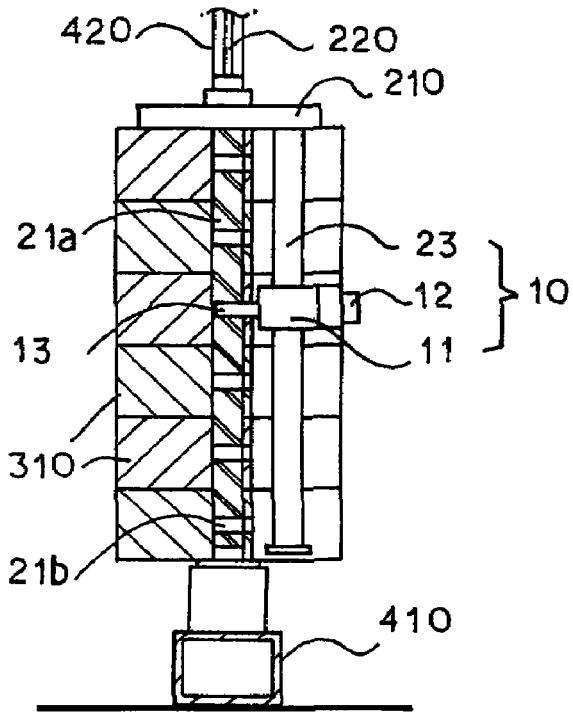
FIG. 4 is a sectional side view, partly broken away, of a weight training machine with a device for controlling weight according to the present invention mounted.

Referring to FIG. 3 and FIG. 4, in which a weight training machine with a device for controlling weight according to the present invention mounted is shown, two guides 420 are mounted vertically in parallel with each other at regular spacing to the upper part of a base 410, to which a supporting stand is mounted. To the guides 420 is mounted movably up and down a plate 210.

To the central lower part of the plate 210 is mounted a fixing bar 21*a* with a plurality of insert holes 21*b* formed at regular spacing, and to one end of the lower part of the plate 210 are mounted downward a pair of guides 23. To the guides 420 mounted on the base 410 are attached a plurality of stacks 310. Each of the stacks 310 is formed in the shape of a brick with a depressed side. Each of the stacks 310 is provided at either end thereof with a bearing 312, through which the guide 420 is inserted. The stack 310 is provided at the central part thereof with a hole, through which the fixing bar 21*a* is inserted. At the side of the depressed part of the stack 310 is formed an insert hole 311, through which a fixing pin 13 of a fixing unit 10 is inserted, which will be described below.

Figure 5A:
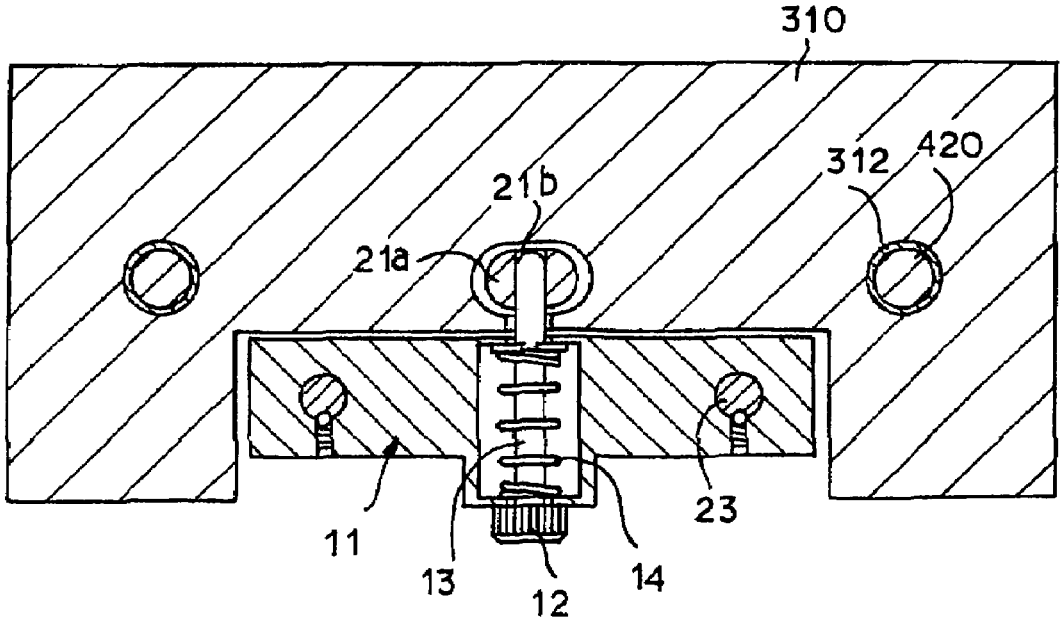
FIG. 5A is a sectional plan view, partly broken away, of a weight training machine with a device for controlling weight according to the present invention mounted.
Figure 5B:
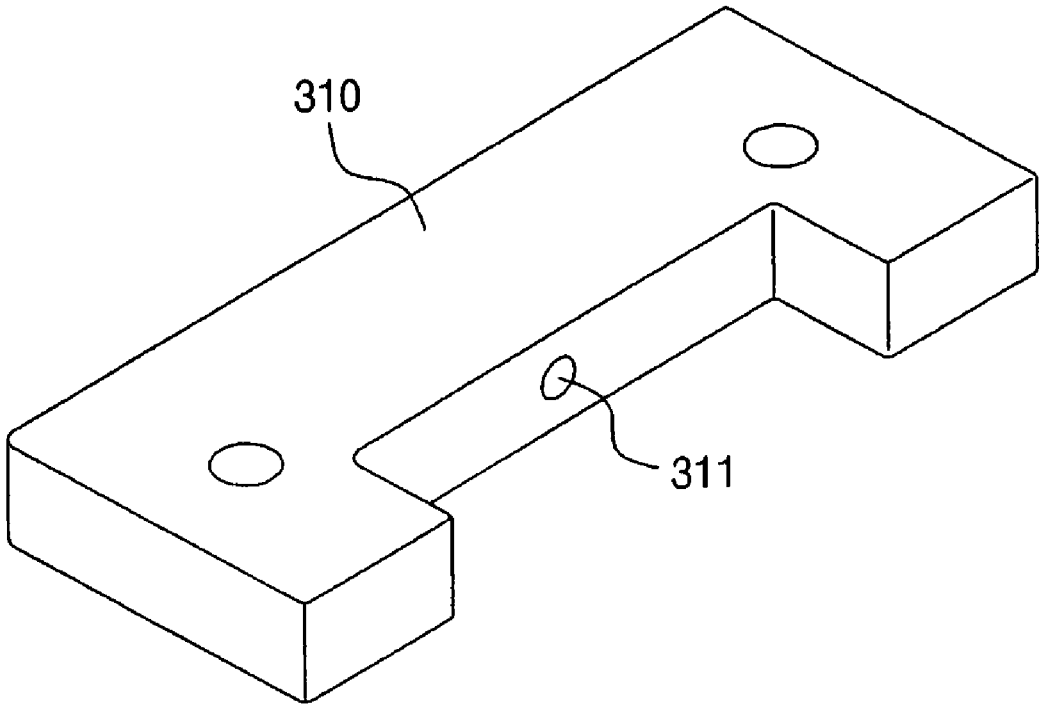
FIG. 5B is a specific elevational view of a stack in FIG. 5A.
Figure 6:
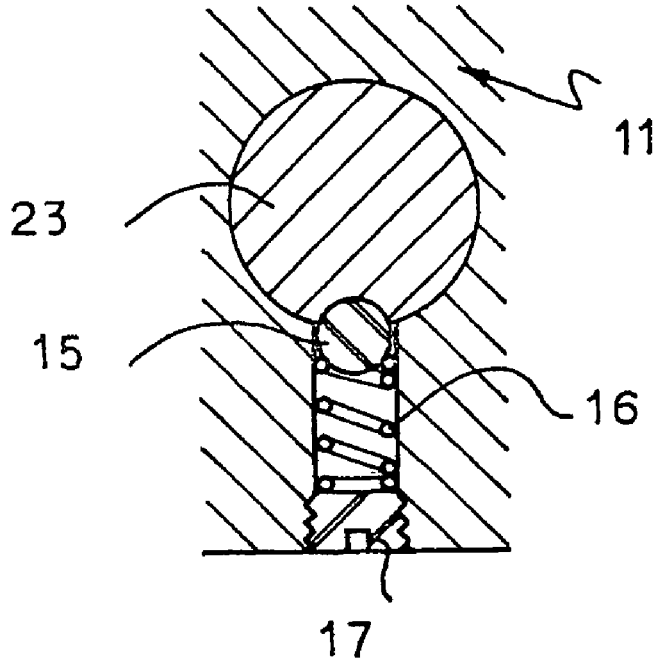
FIG. 6 is a cross sectional view of positioning means according to the present invention.
Figure 7:
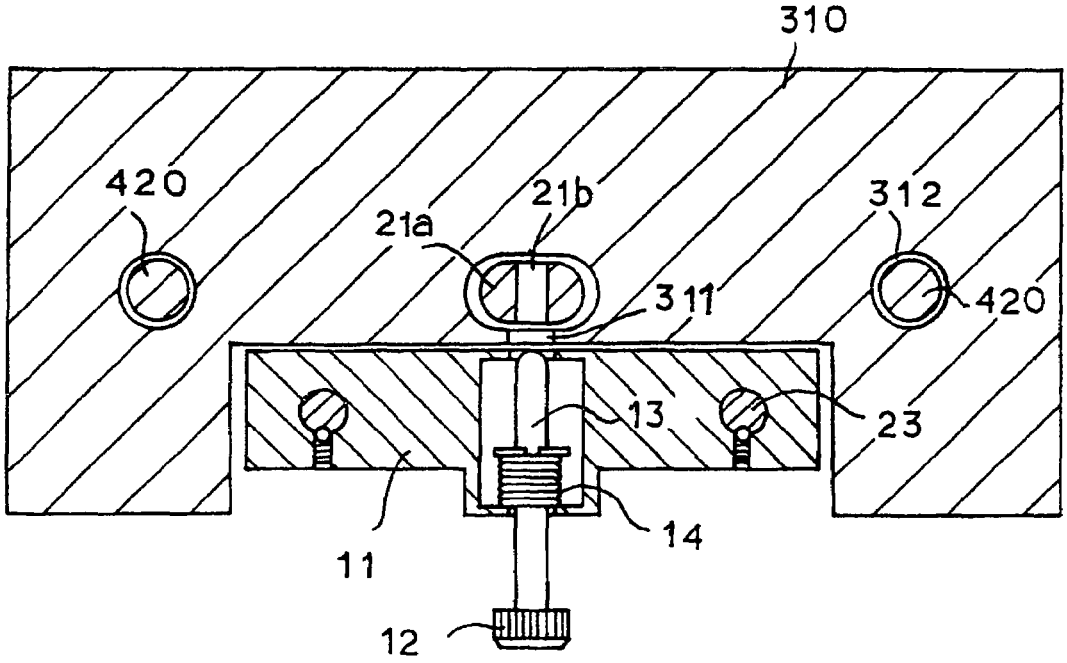
FIG. 7 is a view showing a state that a fixing bar according to the present invention is disengaged from a stack.

The guide 23 mounted to the one end of the plate 210 is placed at the depressed part of the stack 310. The guide 23 is provided at the one side thereof with a plurality of stop grooves 23*a* along its longitudinal direction at the positions corresponding to the insert holes 311. To the guide 23 is mounted a fixing unit 10, which will be described below. The fixing unit 10 is mounted slidably up and down along the guide 23 at the both ends thereof, as shown in FIG. 5 and FIG. 7. A ball 15 is mounted in a hole formed laterally at the position of a body 11 of the fixing unit 10 through which the guide 23 is inserted so that the fixing unit 10 can stop at the position of the stop groove 23*a* of the guide 23. As shown in FIG. 6, a spring 16 is mounted to one end of the ball 15 in such a manner that the ball 15 can be in close contact with one side of the guide 23, and then a mood bolt 17 is inserted so that the spring 16 cannot be disengaged.

With the above-mentioned structure, the ball 15 is engaged into the stop groove 23*a* formed at the guide 23, and thus the fixing unit 10 is stopped. The body 11 of the fixing unit 10 is provided at the central part thereof with a receiving chamber, which passes through laterally, and in the receiving chamber is mounted a spring 14. The fixing pin 13 supported by the spring 14 is inserted through the insert hole 311 formed at the side of the stack 310, and then inserted into the insert hole 21*b* formed at the side of the fixing bar 21*a*. To one side of the fixing pin 13 is mounted a handle 12. In the fixing unit 10 mounted to the guide 23 as described above, when the handle attached to the fixing pin 13 is pulled, the spring 14 is compressed and the fixing pin 13 is disengaged from the insert hole 21*b* formed at the side of the fixing bar 21*a* and then from the insert hole 311 formed at the side of the stack 310.

At this time, if a user moves the fixing unit 10 up or down to change the position so that the desired stack can be connected to the fixing bar, and then the handle 12 is released, the fixing pin 13 is inserted through the insert hole 311 of the stack 310 and then into the insert hole 21*b* of the fixing bar 21*a* by virtue of the spring force of the spring 14. When the fixing unit 10 is moved up or down, the ball 15 mounted to the body 11 of the fixing unit 10 is engaged into the stop groove 23*a* formed at the side of the guide 23, so that the position where the fixing unit 10 is stopped can be determined correctly.

Such a fixing unit has the structure that a user can operate directly the device for controlling weight at site so that the desired stack can be connected to the fixing bar.

Figure 8:
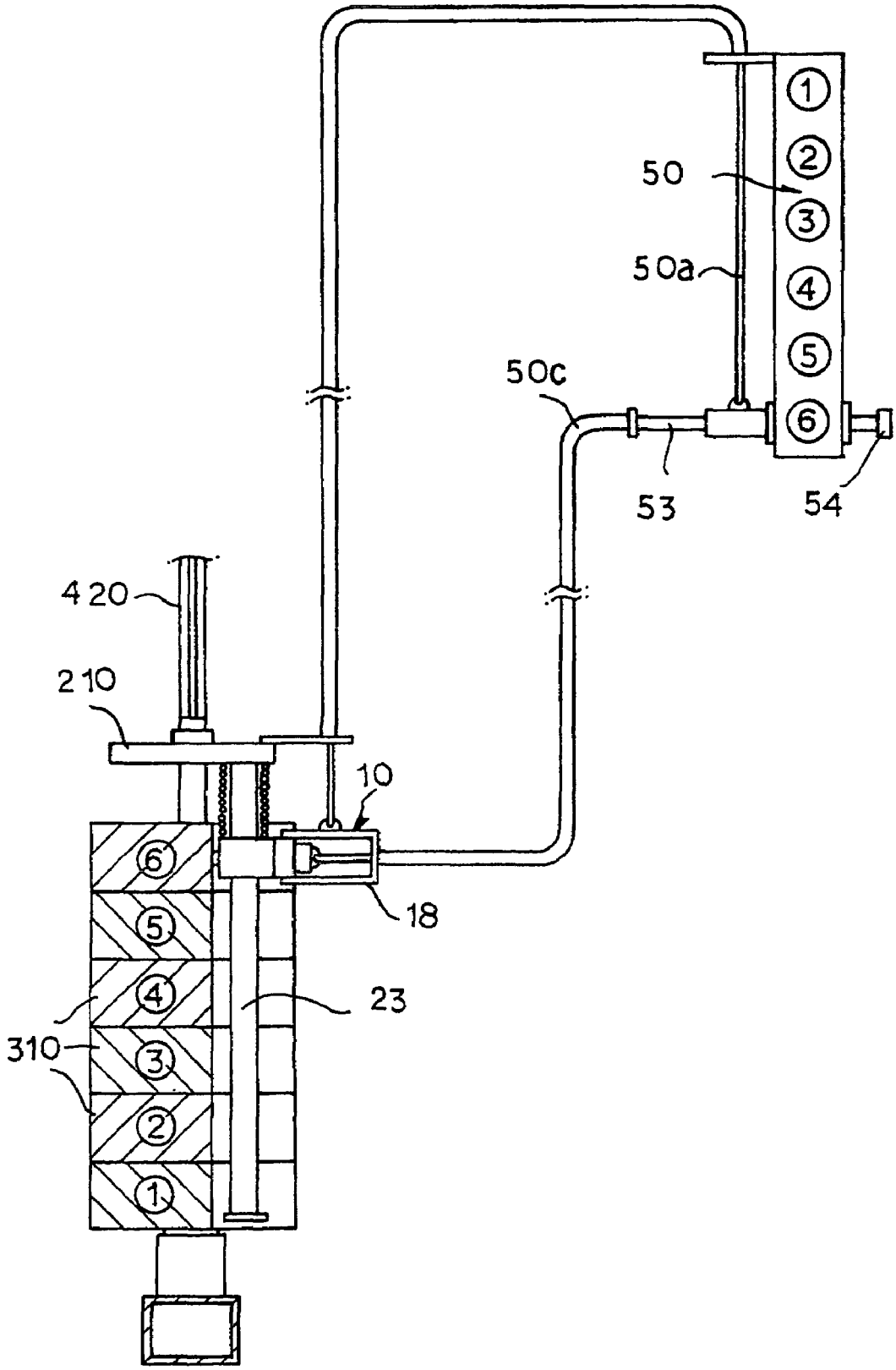
FIG. 8 is a view showing a weight training machine according to another preferred embodiment of the present invention with means for controlling remotely a device for controlling weight according to the present invention mounted.
Figure 9:
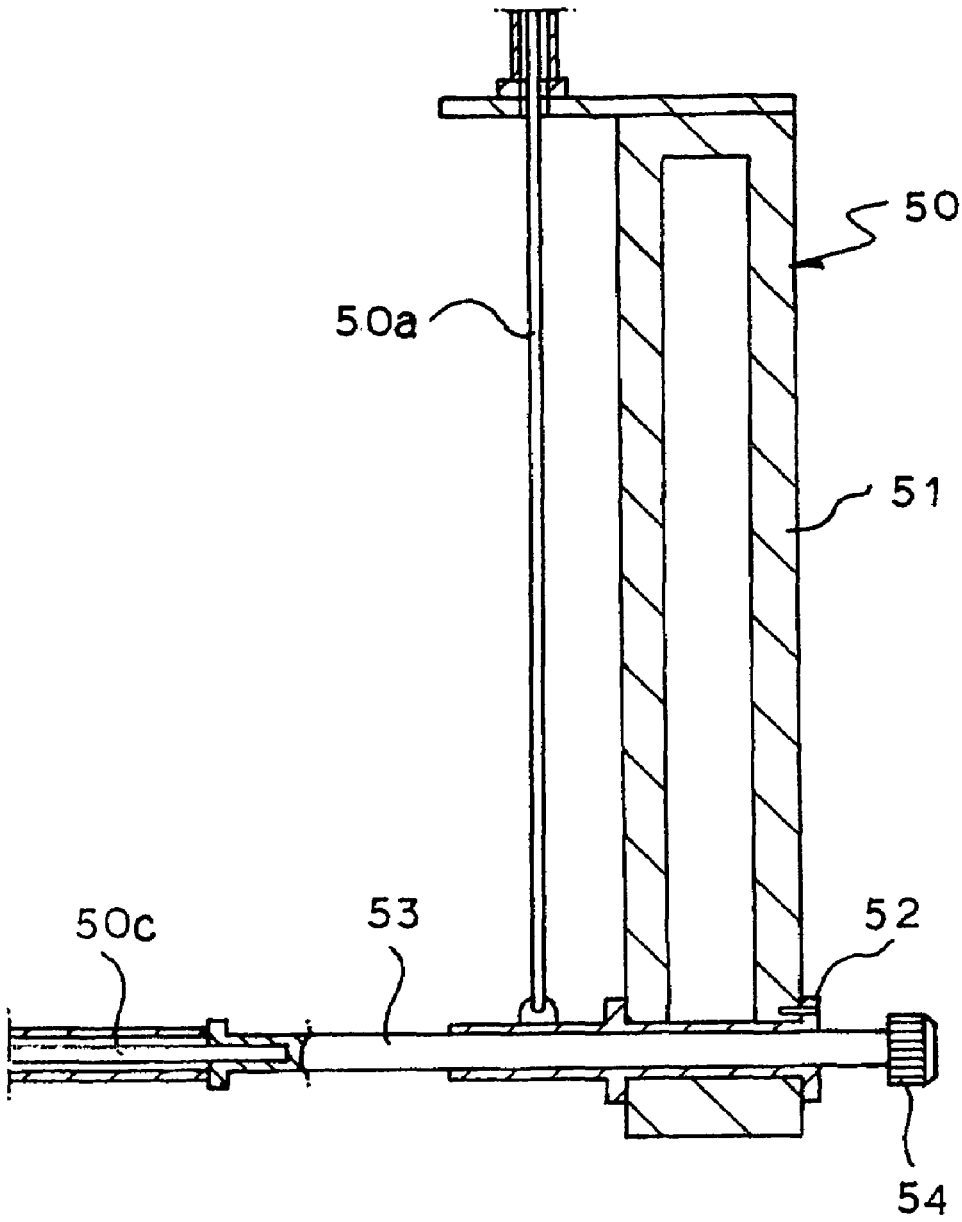
FIG. 9 is a sectional side view showing the structure of a control plate as shown in FIG. 8.
Figure 10:
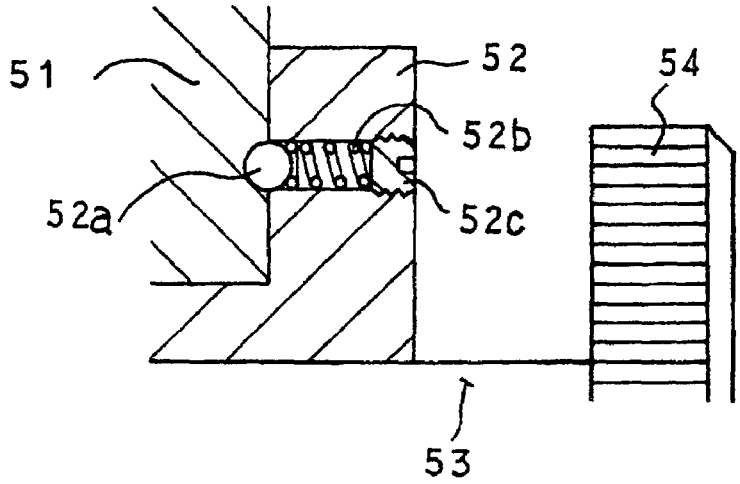
FIG. 10 is a cross sectional view of positioning means according to the present invention.

FIG. 8 and FIG. 9 show a weight training machine with a control unit 50 for controlling remotely the fixing unit 10 mounted. The control unit 50 has several wires 50*a* and 50*c*, which are connected to the body 11 of the fixing unit 10 and the handle 12, so that the position of the fixing unit 10 can be changed at a distance. The wire 50*a* is mounted vertically to the plate 210, to which the guide 420 is mounted. To the body 11 of the fixing unit 10 is attached a case 18 for covering the handle 12, and the wires 50*a* and 50*c* are connected to the upper part of the case 18 and the handle 12, respectively. The wires 50*a* and 50*c* are connected to the control unit 50, which has the following structure.

Figure 11:
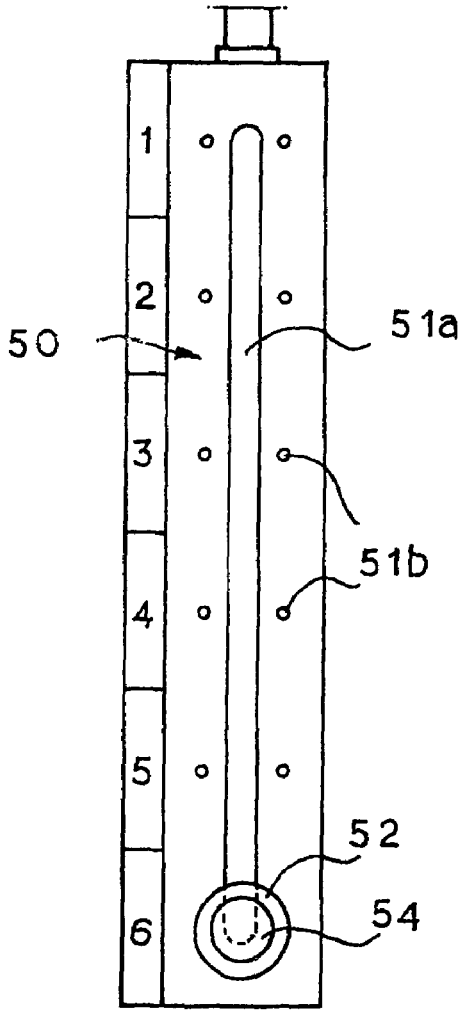
FIG. 11 is a front elevational view of a control plate according to the present invention.

At the front of a body 51 of the control unit 50 is formed a guide hole 51*a* of slot shape along the longitudinal direction, and at the both sides of the guide hole 51*a* are formed a plurality of stop grooves 51*b* at the regular spacing corresponding to the stop grooves 23*a* formed at the guide 23, to which the fixing unit is mounted. In the guide hole 51*a* is arranged a slider 52 of flange shape, as shown in FIG. 11. To one end of the slider 52 is connected the wire 50*a*, by which the fixing unit 10 can slide up or down. The slider 52 is provided at the central part thereof with a through hole, through which an actuating bar 53, one end of which a handle 54 is attached, is inserted. The other end of the actuating bar 53 is connected the wire 50*c*, which is connected to the handle 12 of the fixing unit 10.

At the end of the slider 52, which is in contact with the front of the control unit 50, is formed a hole, and a ball 52*a* and a spring for urging the ball 52*a* into the stop groove 51*b* are mounted into the hole, like the stop means (the ball and the spring) attached to the fixing unit 10 for positioning. The ball and the spring are fixed by means of a mood bolt 52*c*. The fixing unit is moved up or down by the control unit 50 constructed as described above. When the handle 54 of the control unit 50 is pulled, the wire 50*c* is pulled and the handle 12 of the fixing unit 10 is pulled. After that, when the handle 54 of the control nit 50 is moved up or down, the fixing unit 10 is moved in the opposite direction, that is, down or up by means of the wire 50*a* connected to upper part of the fixing unit.

With the structure as described above in detail, the control unit 50 can be mounted near the position where a user is training, and the user can control weight of the stack while the user do not need to move in order to control the weight of the stack during the training.

Figure 12:
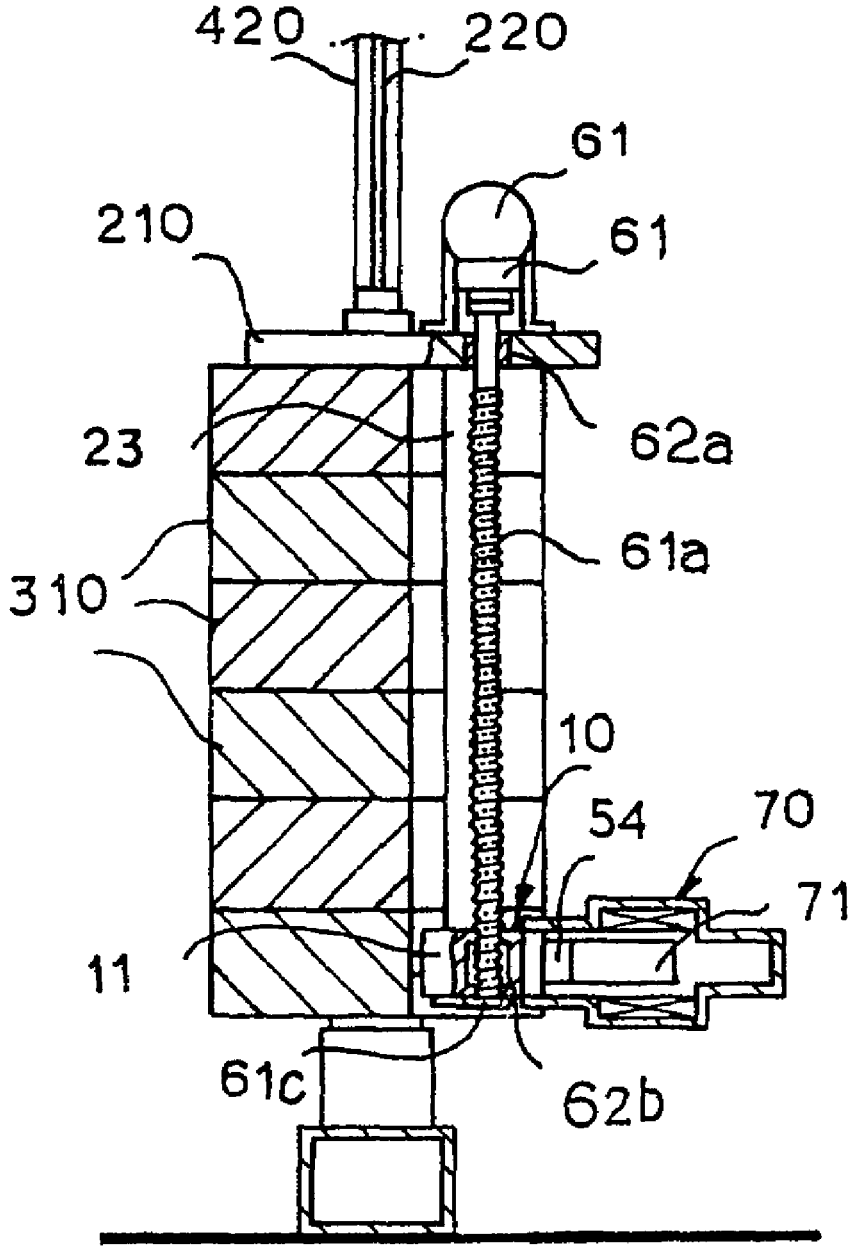
FIG. 12 is a view showing a weight training machine according to still another preferred embodiment of the present invention with different means for controlling remotely a device for controlling weight according to the present invention mounted.
Figure 13:
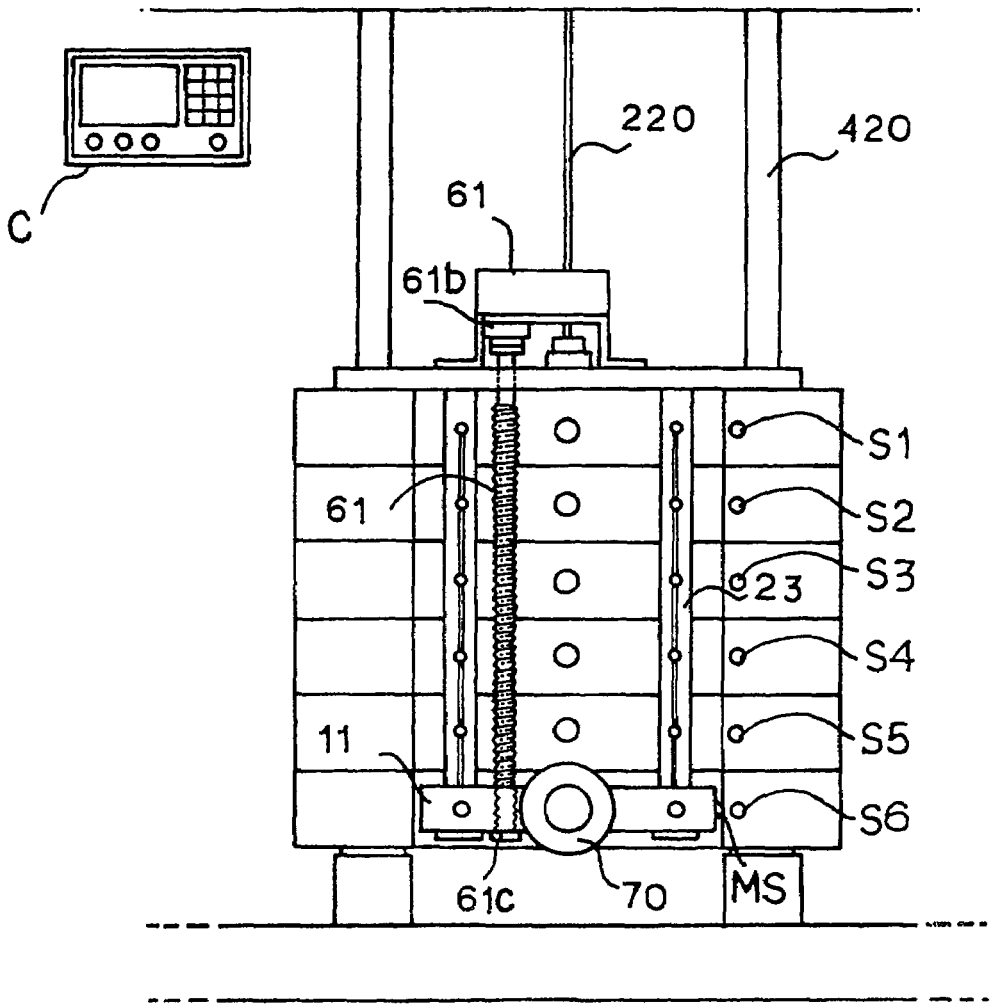
FIG. 13 is a front elevational view of a device for controlling weight as shown in FIG. 12.

Control means using a solenoid 70 different from the aforesaid control unit 50 is shown in FIG. 12 and FIG. 13. Such control means includes a motor 61 mounted to the plate 210 at one side thereof. To the shaft of the motor 61 is mounted a reducer 61*b*, to which the upper end of a gear bar 61*a* with gears formed at the outer circumstance is attached. The lower end of the gear bar is inserted through the plate 210 and then through the body 11 of the fixing unit 10. The lower end of the gear bar 61*a* is engaged into an inscribed gear 62*b* in the body, and to the lower end of the gear bar running through the body 11 is formed a stopper 61*c*.

To the outer circumstance of the gear bar 61*a* running through the plate 210 is mounted a bearing 62*a*, and the inscribed gear 62*b* is engaged with the outer circumstance of the gear bar 61*a* running through the body 11 of the fixing unit 10. To one end of the handle 12 of the fixing unit 10 is mounted the solenoid using an electromagnet, and to a plunger 71 of the solenoid 70 is attached the handle 12. When the solenoid 70 is actuated, the plunger 71 is moved rearward so that the handle is pulled. The motor 61 and the solenoid 70 are connected electrically to a control panel C with an electronic circuit mounted. The motor and the solenoid are actuated by a signal from the control panel C. That is to say, if the user selects weight of the stack 310 using the control panel C, the solenoid 70 is actuated to pull the handle 12 so that the fixing pin 13 can be disengaged from the fixing bar 21*a* and the stack 310. After that, the motor 61 is rotated, and the gear bar 61*a* is rotated by means of the reducer 61*b*. At the same time, the body 11 of the fixing unit 10 is moved up or down along the gear bar 61*a* by the inscribed gear 62*a* in the body 11 of the fixing unit 10, and the position of the fixing unit 10 is determined. A sensor MS provided at one side of the fixing unit 10 senses sensors S1, S2, S3, S4; S5 and S6 provided at each of the stacks 310 so that the position of the fixing unit can be determined. After that, the operation of the solenoid 70 is released with the result that the fixing pin 13 is inserted through the hole 311 of the stack 310 and then inserted into the hole 21*b* of the fixing bar 21*a*.

Figure 14:
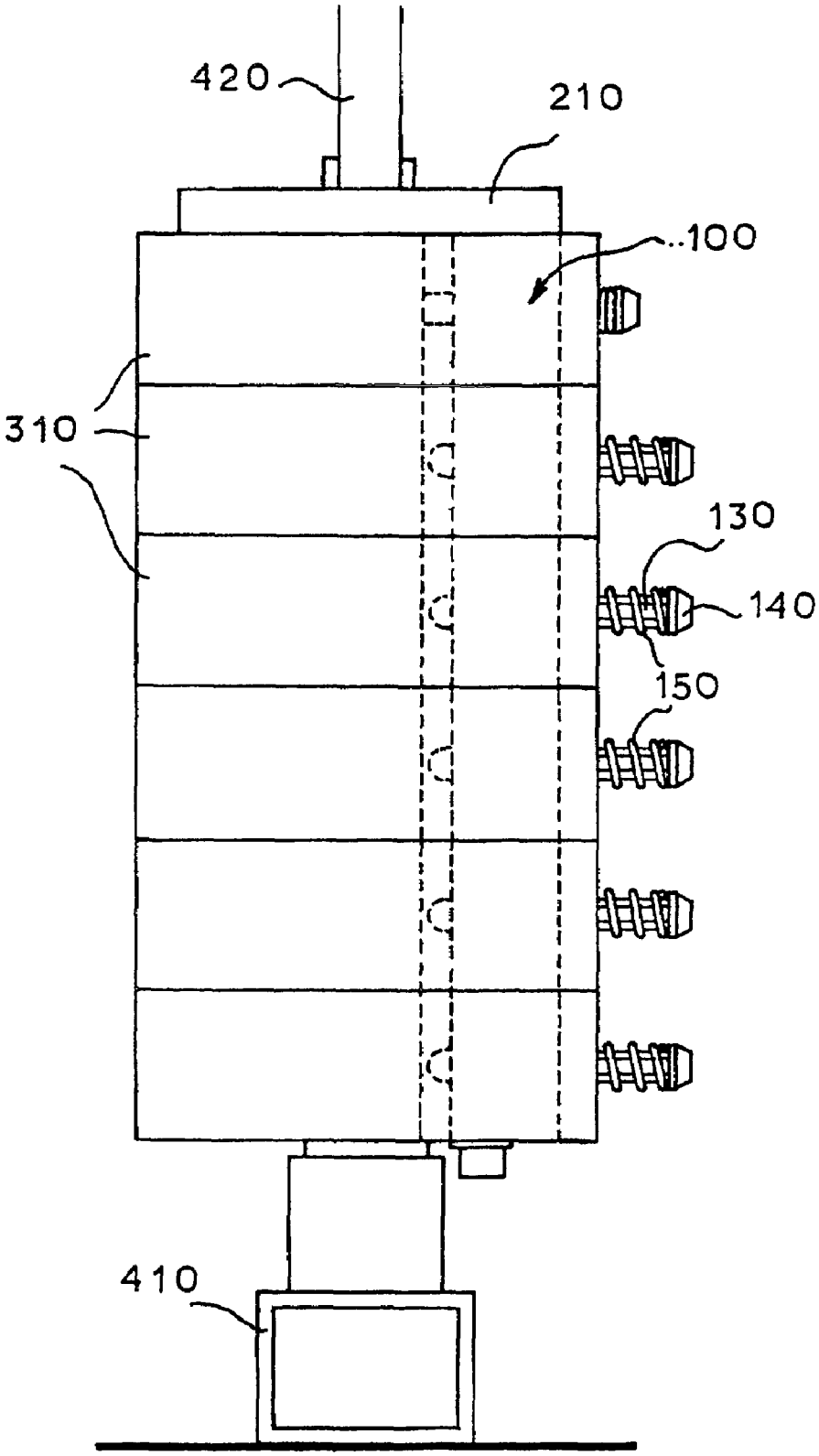
FIG. 14 is a side elevational view of a weight training machine according to still another preferred embodiment of the present invention.
Figure 15:
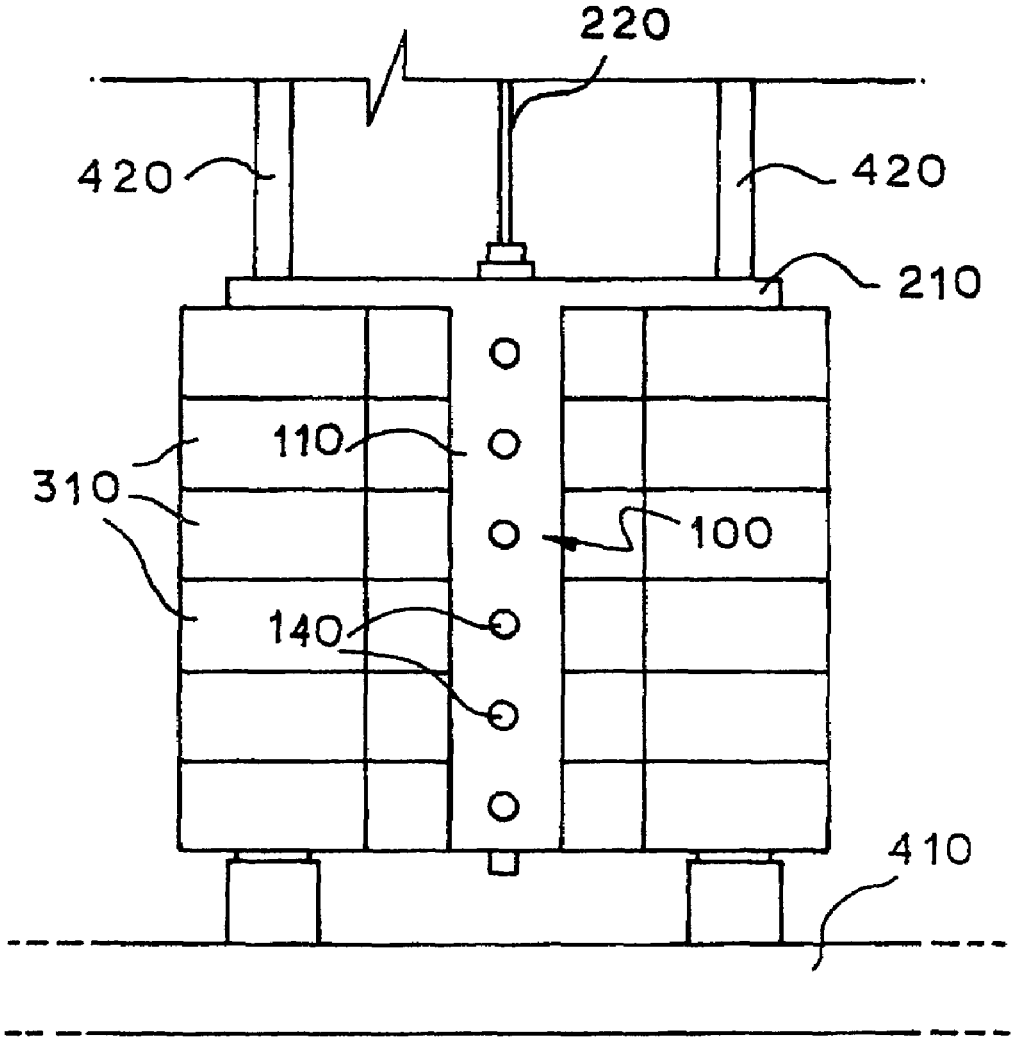
FIG. 15 is a front view of a weight training machine according to the present invention.

FIG. 14 and FIG. 15 show a weight training machine with a device for controlling weight according to still another preferred embodiment of the present invention. To one end of the lower part of the plate 210 is mounted downward a fixing unit 100 with a plurality of fixing pins 130.

To the guide 420, which is mounted to the upper part of the base 410, are attached a plurality of stacks 310. Each of stacks 310 is formed in the shape of a brick with a depressed side. Each of the stacks 310 is provided at either end thereof with a bearing, through which the guide 420 is inserted. At the side of the depressed part of the stack 310 is formed an insert hole 311, through which a fixing pin 130 of a fixing unit 100 is inserted.

Figure 16:
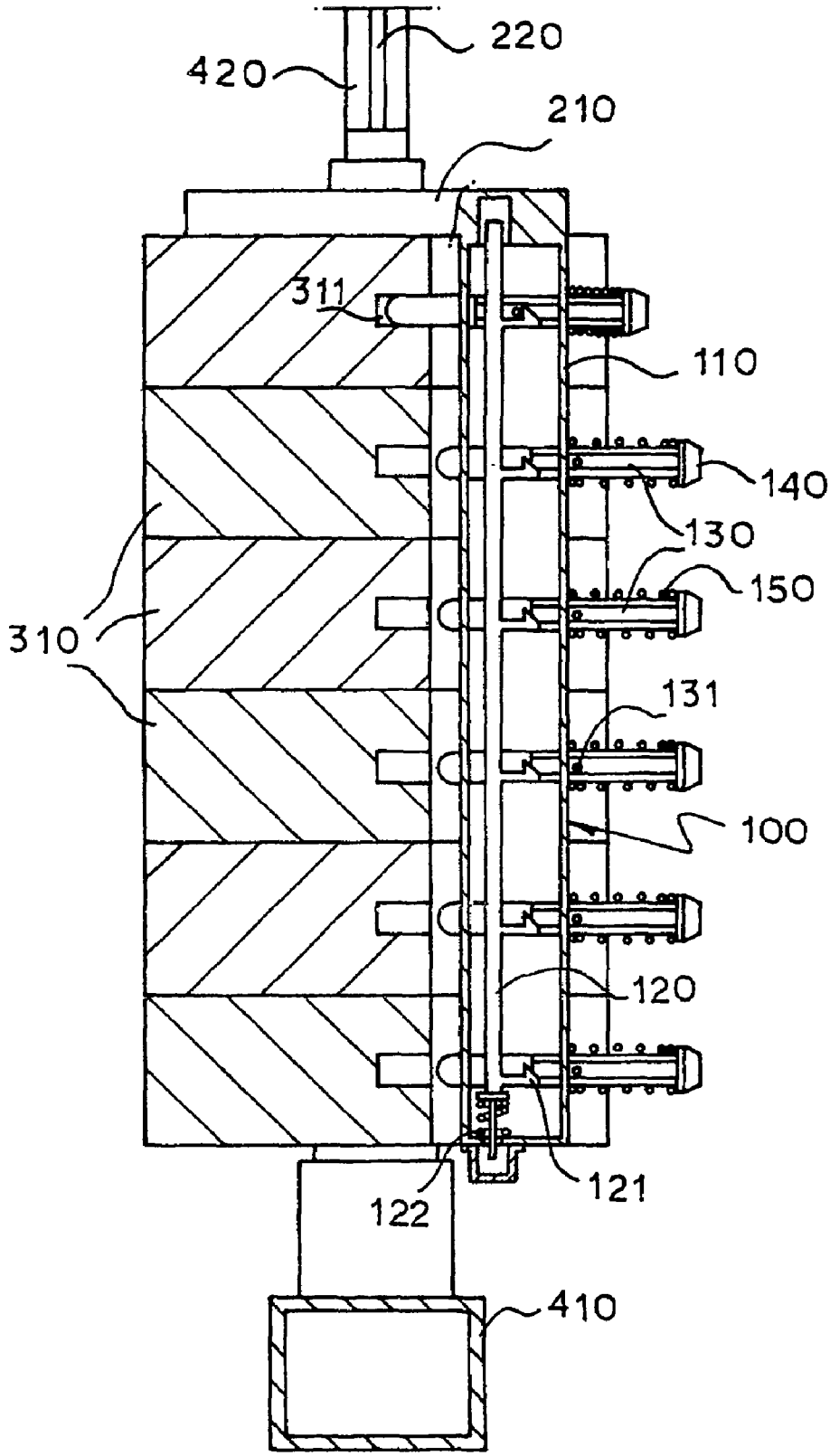
FIG. 16 is a sectional side view showing the structure of a weight training machine according to the present invention.

The fixing unit 100 mounted to the one end of the plate 210 is placed at the depressed part of the stack 310. The fixing unit 100 has a fixing unit body 110 of hollow rectangular shape as shown in FIG. 16, in which a latching member 120 with a plurality of hooks 121 is mounted in the longitudinal direction. To the lower end or the upper end of the latching member 120 is arranged a spring 122. Consequently, the latching member 120 is supported by virtue of the spring force of the spring in the upper direction or the lower direction while it is moved up or down, and engaged with the fixing pin 130.

Figure 17:
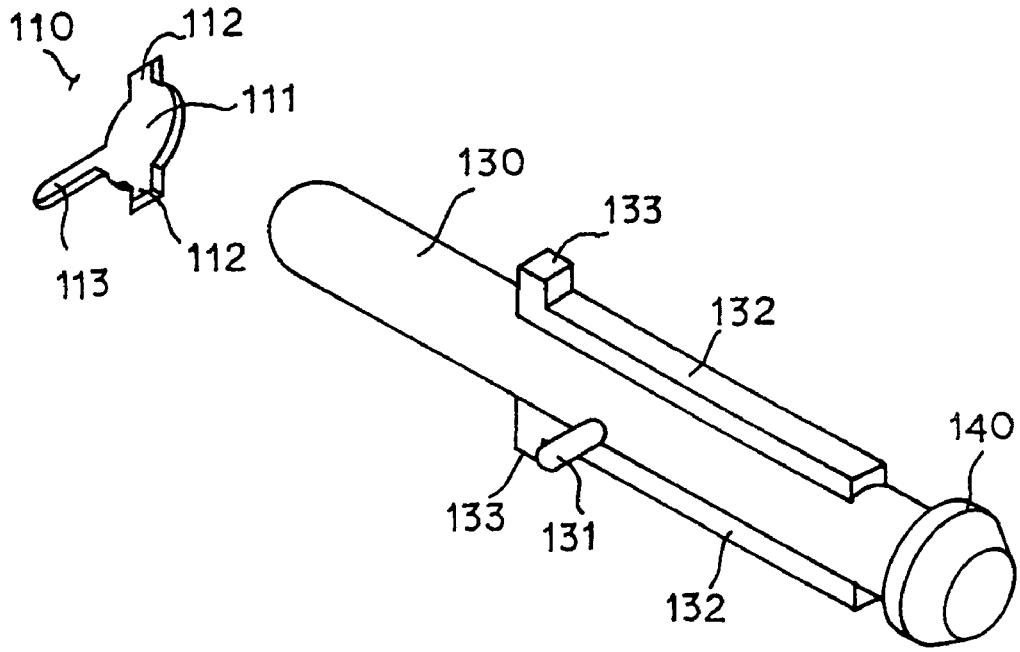
FIG. 17 is a perspective view of a button according to the present invention.

A plurality of the fixing pins 130 is inserted through from the front of the fixing unit body 110 to the rear of the fixing unit body 110. At one end of the fixing pin 130 is formed a button 140, and between the button 140 and the outer surface of the fixing unit body 110 is arranged a spring 150, which supports the fixing pin 130. The fixing pin 130 is provided at the both sides thereof with guide projections 132 in its longitudinal direction as shown in FIG. 17, and at one side thereof with latching projections 131, which are engaged with the hooks 121 of the latching member 120. And to the end of the guide projection 132 is formed a latching step 133, which is inserted into the fixing unit body 110 so that it is not disengaged from the fixing unit body 110 by virtue of the spring force of the spring 150 arranged between the fixing unit body 110 and the button 140.

At the side of the fixing unit body 110, into which the fixing pin 130 is inserted, is formed a guide groove 112 corresponding to the guide projection 132 formed along the lateral longitudinal direction of the fixing pin 130, and a groove 113 corresponding to the latching projection 131. With the fixing unit 100 constructed as described above, the user can push the button 140 of one of the fixing pins 130 selected in such a manner that the stack with the desired weight is engaged with the fixing pin 130, to have the fixing pin 130 pushed inward so that the it can be inserted into the insert hole 311 of the stack 310. At this time, the latching projection 131 of the fixing pin 130 is engaged with the hook 121 of the latching member 120.

On the other hand, when the user push another button to select different weight, the latching projection 131 of the other button 140 pushes downward the hook 121 of the latching member 120. As a result, the latching member 120 is pushed downward so that the latching projection 131 of the fixing pin 130 which has been engaged with the hook 121 is released, and at the same time the spring 122 is actuated upward so that the latching projection 131 of the other fixing pin 130 is engaged with the hook 121 to lock up the fixing pin 130.

Figure 18:
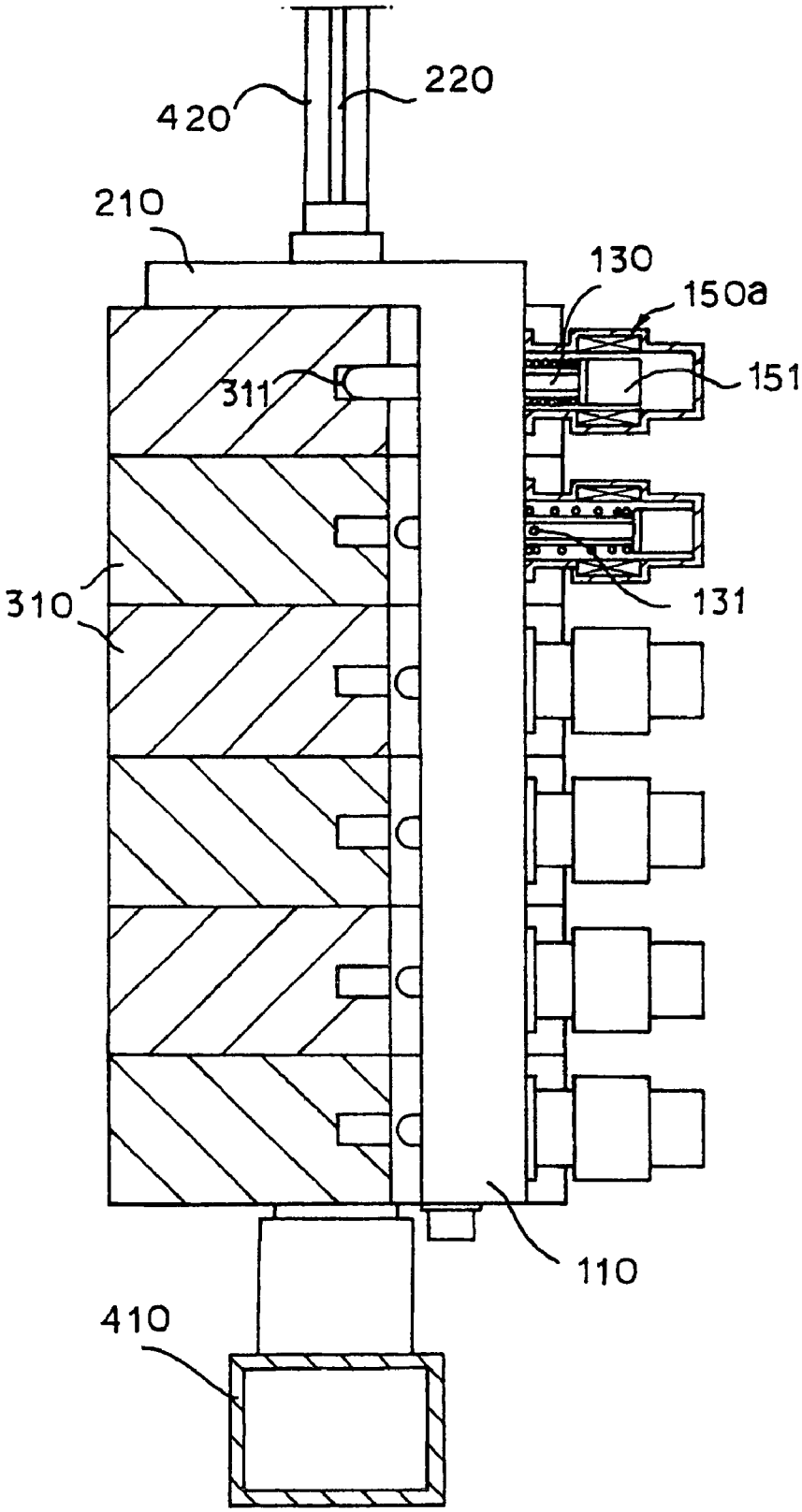
FIG. 18 is a view of a weight training machine according another preferred embodiment of the present invention with a solenoid for actuating automatically a fixing pin according to the present invention mounted.
Figure 19:
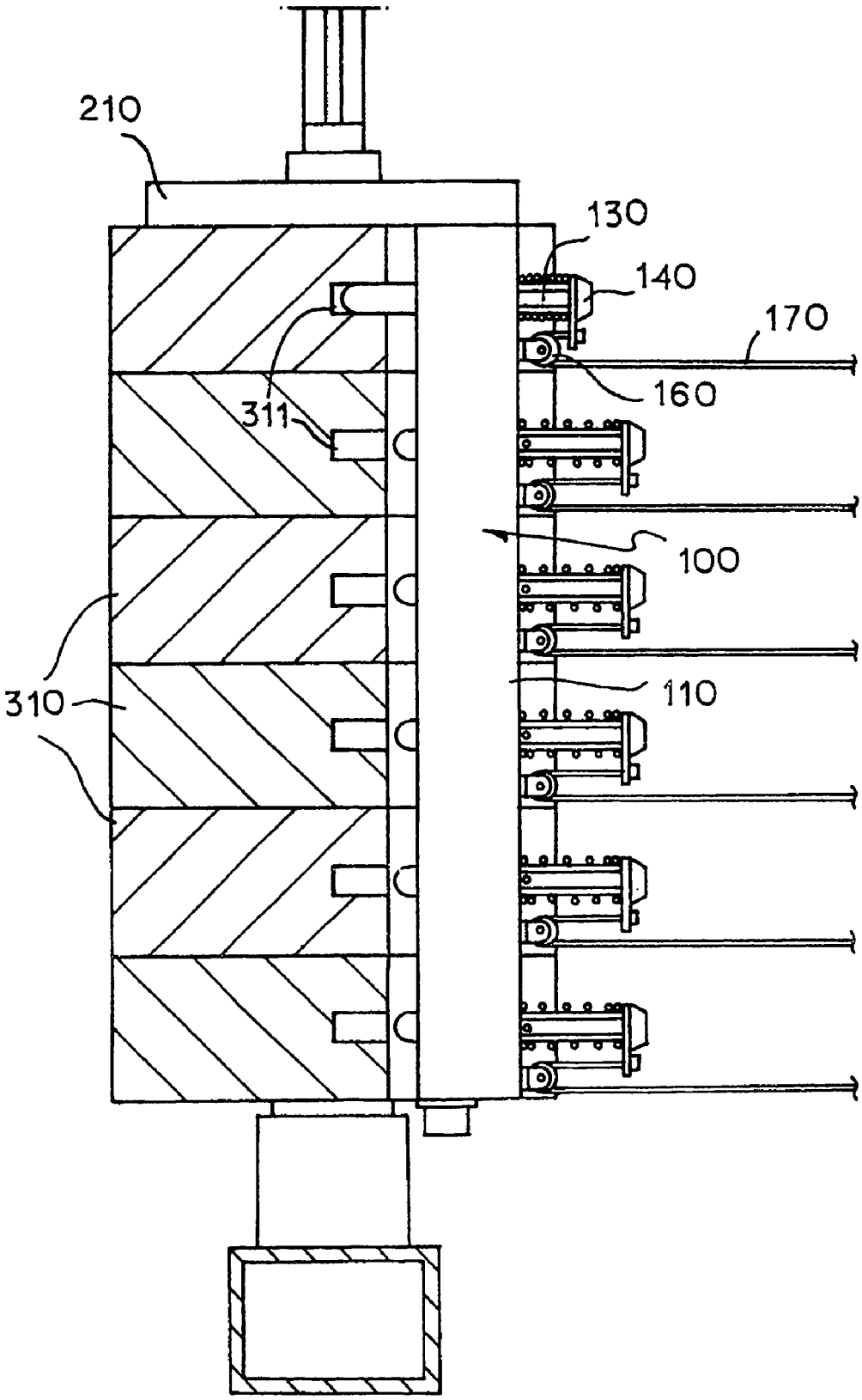
FIG. 19 is a view of a weight training machine according another preferred embodiment of the present invention with means for controlling remotely a device for controlling weight according to the present invention mounted.

The fixing unit 100 may be actuated automatically instead. As shown in FIG. 18, to one side of the fixing pin 130 is attached a solenoid 150. The end of the fixing pin 130 and a plunger 151 of the solenoid 150 are connected with each other. The solenoid 150 attached to the fixing unit 100 is connected to a control unit with an electronic circuit mounted. If the desired weight is selected by the user, the solenoid 150 corresponding thereto is actuated so that the plunger 151 can push the fixing pin 130 inside the fixing unit body 110 of the fixing unit 100. Consequently, the latching projection 131 is engaged with the hook 121 of the latching member 120.

Figure 21:
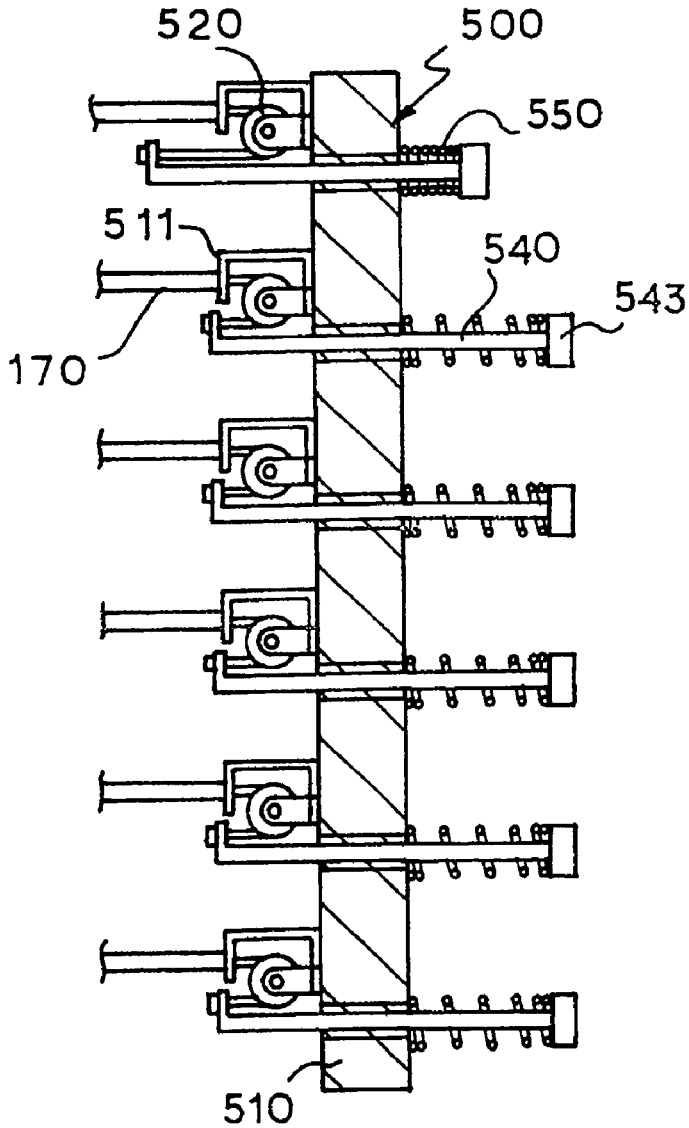
FIG. 21 is a sectional side view, broken away, showing the structure of a control unit.

Means for actuating remotely the fixing unit 100 may be a control unit 500 as shown in FIG. 21. In order that the control unit 500 is linked to the fixing unit 100, to one side of the fixing unit body 110 of the fixing unit 100 is attached a pulley 160 in the vicinity of the fixing pin 130. One end of the wire 170 is connected to one side of the button 140, while the other end of the wire 170 runs onto the pulley and then connected to the control unit 500.

Figure 20:
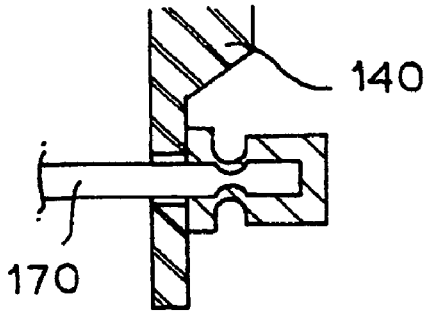
FIG. 20 is a partially enlarged view showing a state that a wire as shown in FIG. 19 is connected.
Figure 22:
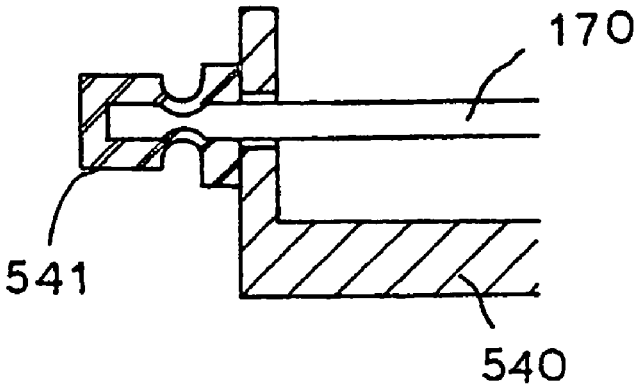
FIG. 22 is a partially enlarged view showing a state that a wire as shown in FIG. 21 is connected.
Figure 23:
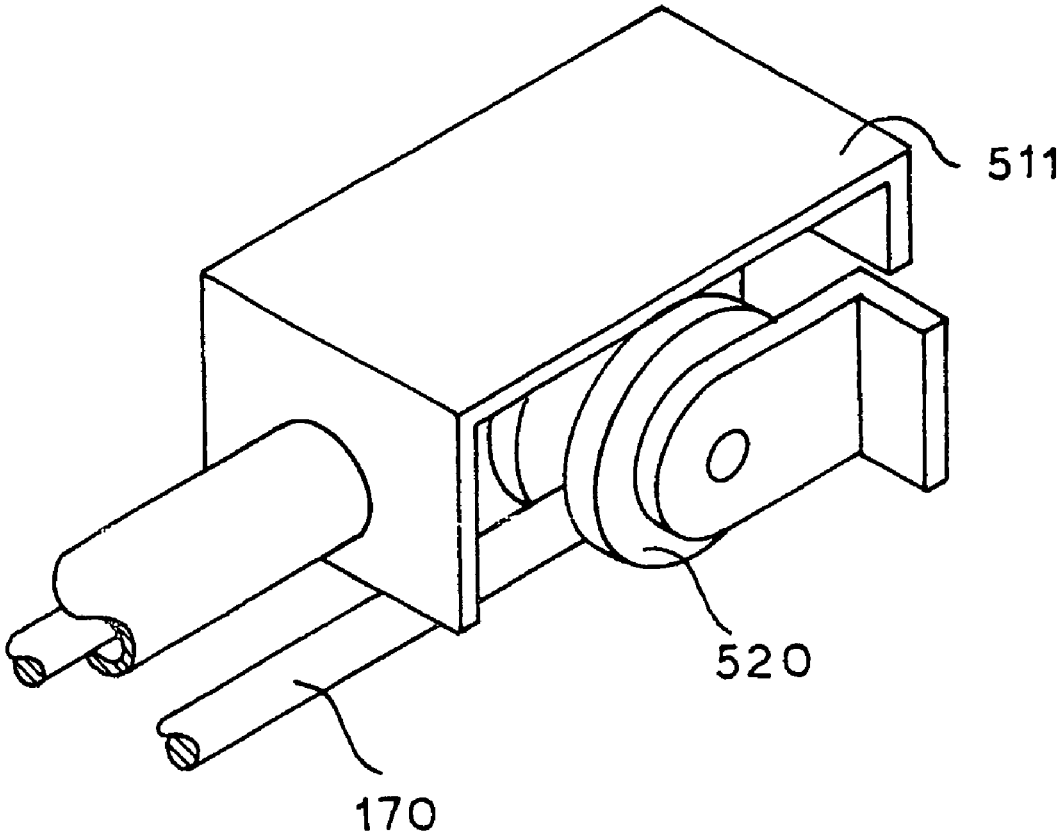
FIG. 23 is a partially enlarged view of a pulley showing a state that a wire as shown in FIG. 21 is connected.

To the end of the wire, which is connected to the button 140, is connected a connecting member 141 as shown in FIG. 20, which fixes the wire 170. The control unit 500 has the structure similar to the fixing unit 100. That is to say, several actuating bars 540 are inserted through from the front of the body 510 of the control unit 500 to the rear of the body 510 of the control unit 500. To one end of the actuating bar 540 is attached a handle 543, while the other end of the actuating bar 540 is bent at a right angle and connected with the wire 170. The rear part of the body 510 of the control unit 500 are attached several pulleys 520 and a supporting member 510 at the position near the actuating bar 540. The wire 170 connected to the actuating bar 540 is wound onto the pulley 520 while it is perpendicular to the body 510 of the control unit 500. And the end of the wire 170, which is connected to the end of the actuating bar 540, is fixed by means of a connecting member 541 as shown in FIG. 22.

The fixing unit 100 is operated by means of the control unit 500 constructed as described above. That is to say, if the handle 543, which is attached to the control unit 500, is pushed, the actuating bar 540 is pushed inward to pull the wire 170. The wire 170 pulls the button 140 of the fixing unit 100 corresponding to the actuating bar 540 so that the fixing pin 130 is pushed inward and then inserted into the insert hole 311 of the stack 310. At this time, the latching projection 131 formed at the fixing pin 130 of the fixing unit 100 is engaged with the hook 121 of the latching member 120. By the operation as mentioned above, the user can actuate the fixing pin 130 of the fixing unit 100 that he or she wants to select so that the fixing pin 130 is connected directly to the stack 310 to control the weight of the stack 310 if necessary.

Figure 24:
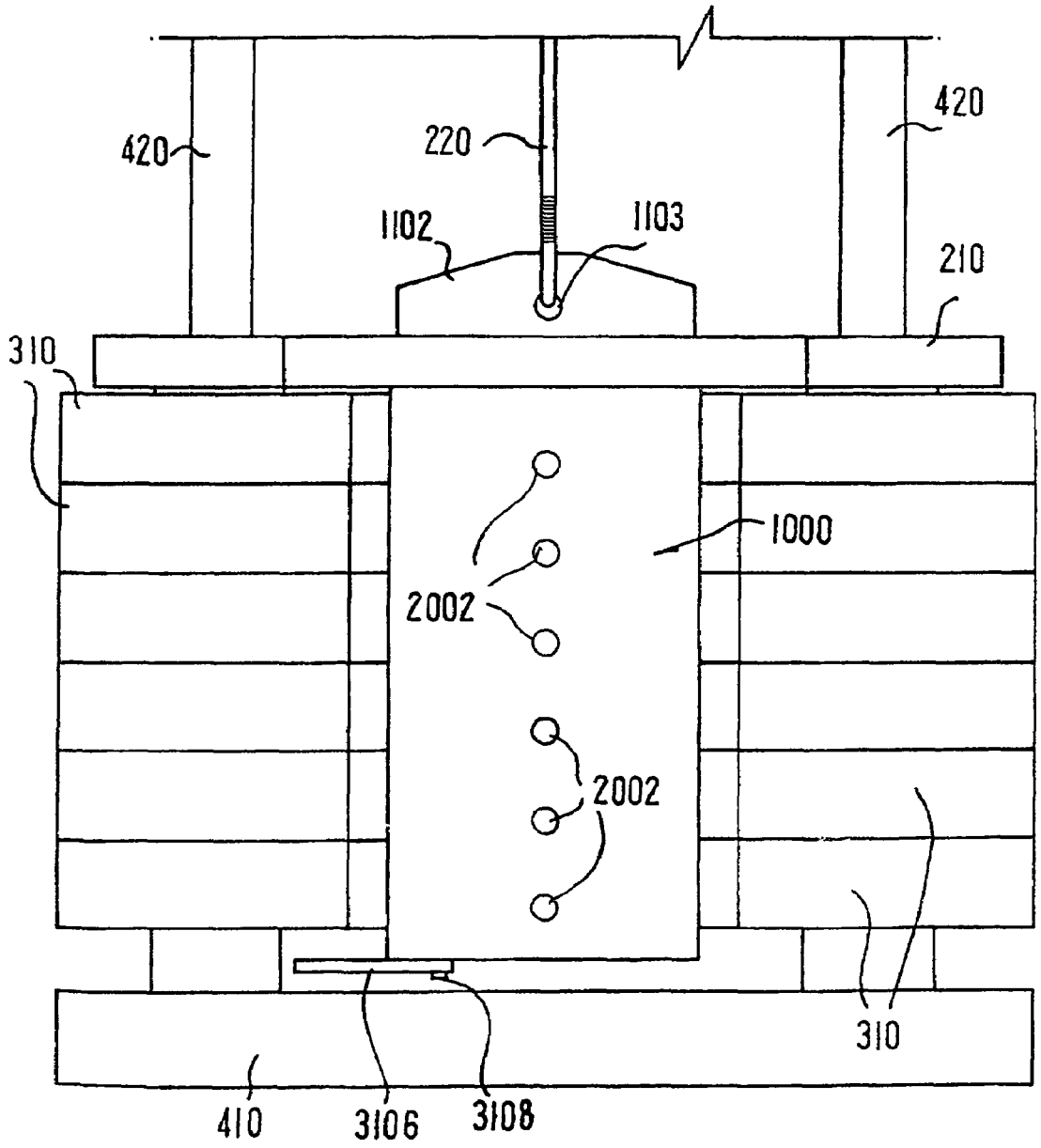
FIG. 24 is a front elevational view of a weight training machine according to still another preferred embodiment of the present invention.
Figure 25:
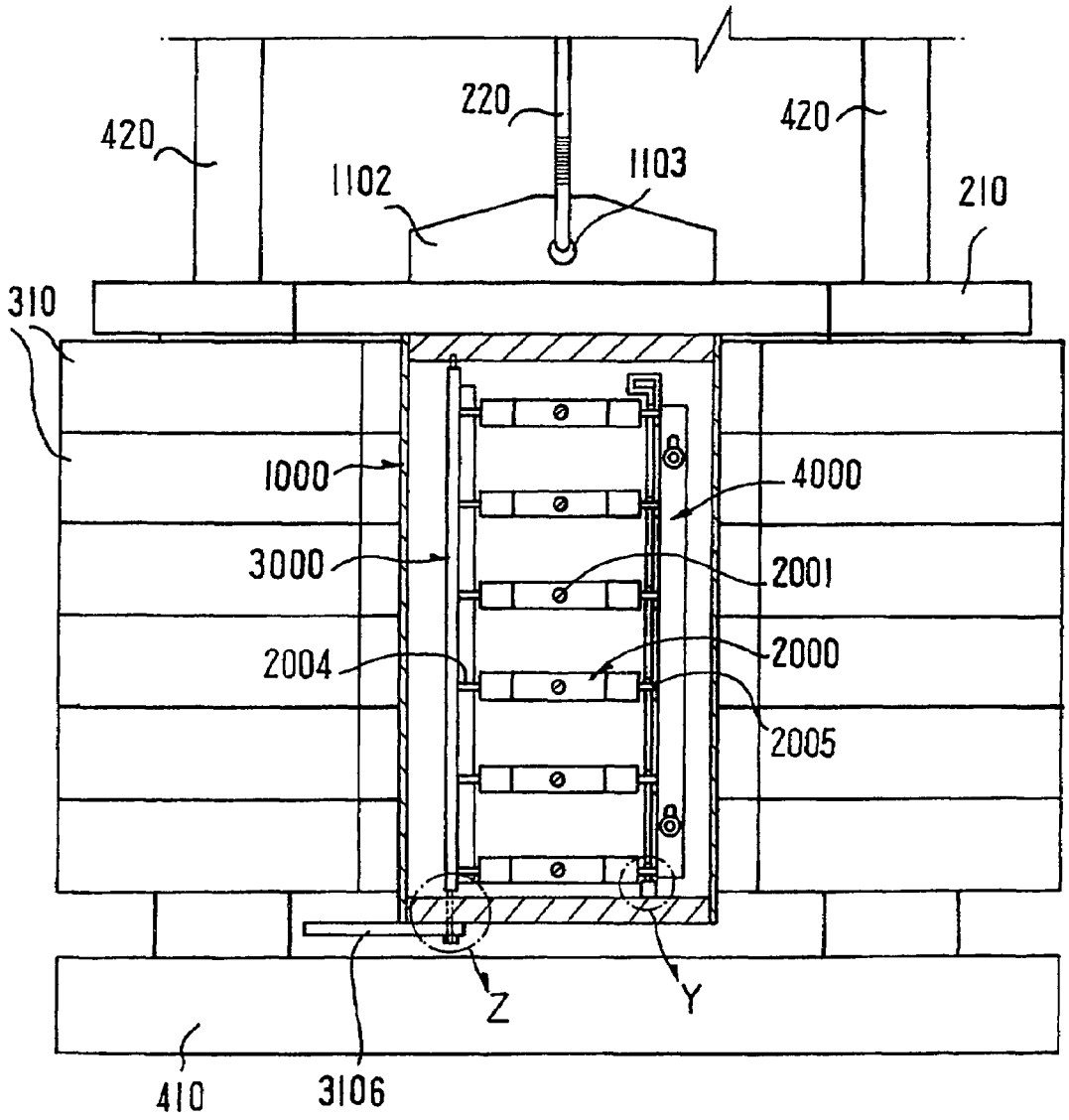
FIG. 25 is a cross sectional view showing the inner structure of a fixing unit according to the present invention.

A safety unit and a disengagement preventing unit of a stack fixing plate of the weight training machine according to the present invention are shown in FIG. 24 and FIG. 25, in which a safety unit 3000 and a disengagement preventing unit 4000 are provided in a fixing unit 1000 mounted to the front central part of the stacks 310.

A pair of guides 420 is mounted in parallel to the upper part of the base 410. To the guides 420 is mounted slidably up and down a plate 210. To the lower part of the plate 210 is mounted a fixing unit 1000 with several fixing plates 2000. To the guides 420 mounted to the upper part of the base 410 are attached several stacks 310, each of which is formed in the shape of a brick with a depressed side. Each of the stacks 310 is provided at either end thereof with a bearing, through which the guide 420 is inserted. At the side of the depressed part of the stack 310 is formed an insert hole 311, through which a fixing plate 2000 of a fixing unit 1000 is inserted, which will be described below.

Figure 27A:
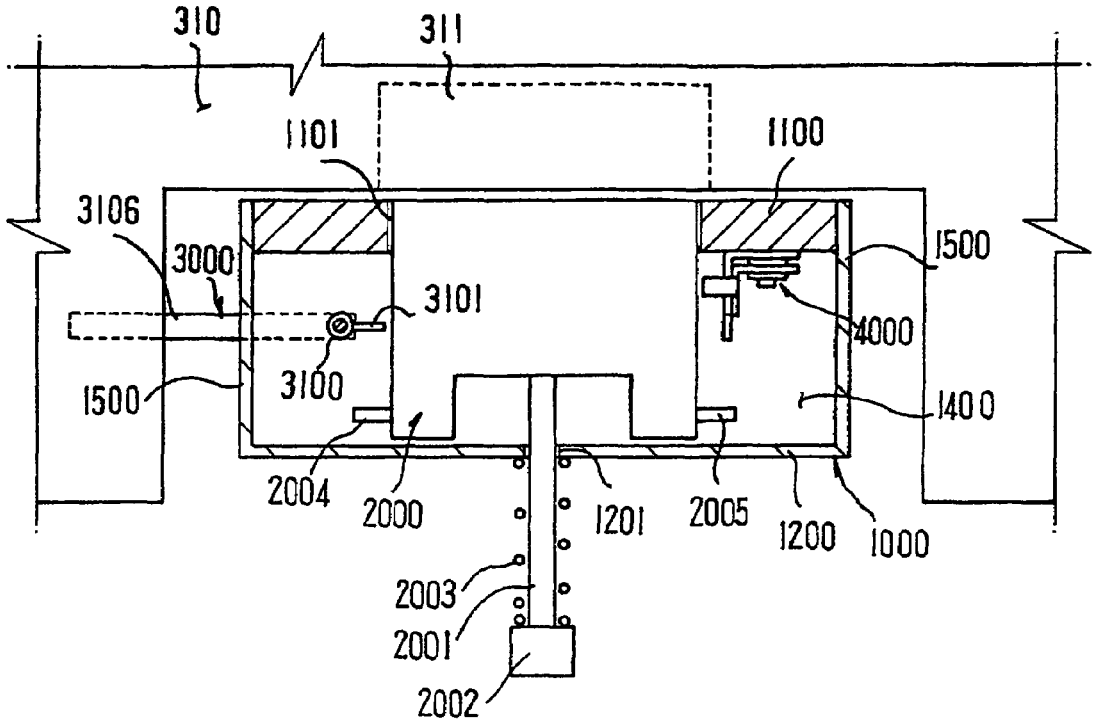
FIG. 27*a* is a sectional plan view of a fixing unit according to the present invention.
Figure 28A:
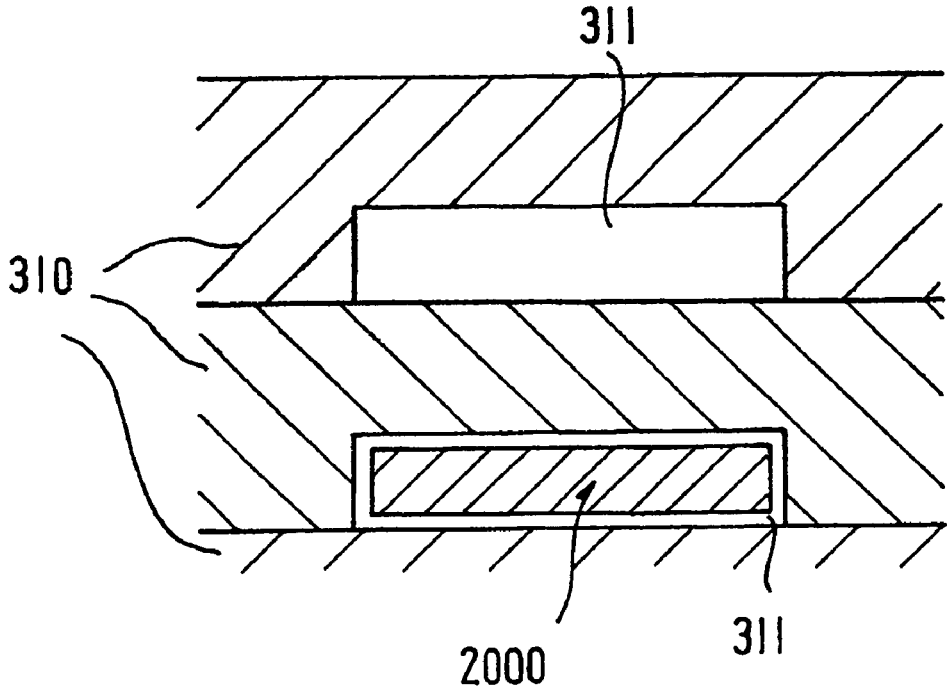
FIG. 28*a* is a view showing a state that a fixing plate according to the present invention is inserted into an insert hole of a stack.

The stack 310 is provided at the center of gravity thereof with an insert hole 311 of rectangular shape, as shown in FIG. 27*a* and FIG. 28*a*. The insert hole 311 has two side faces, a front face and a top face, which all are closed by the stack itself, and a face forming the entrance and a bottom face, which are open.

Figure 26:
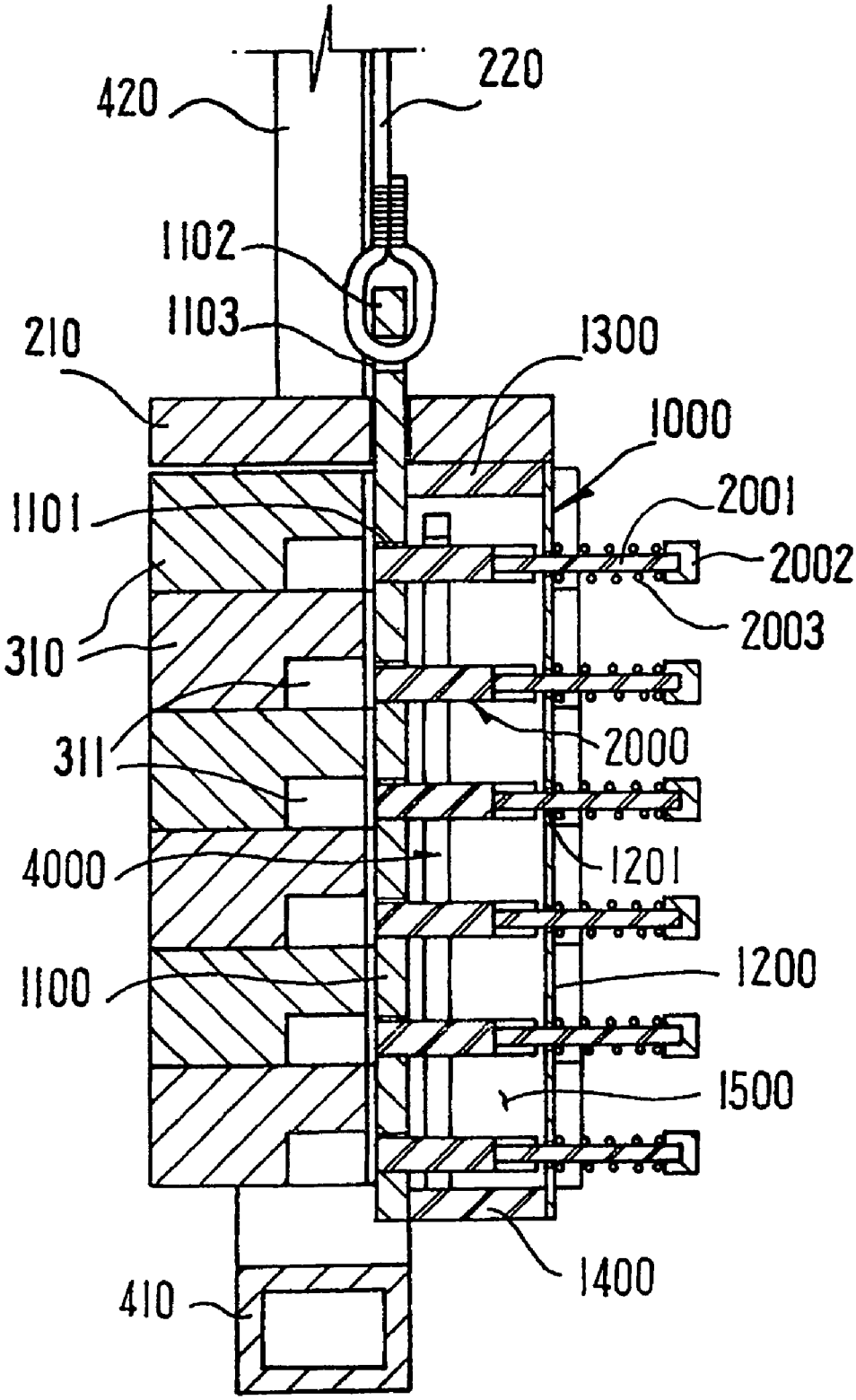
FIG. 26 is a sectional side view of a weight training machine according to the present invention.

The fixing unit 1000 is placed at the depressed part of the stack 310. As shown in FIG. 25 and FIG. 26, the fixing unit 1000 constitutes a cylindrical body of rectangular shape by a front plate 1100, a rear plate 1200, side plates 1500, a top plate 1300 and a bottom plate 1400.

The front plate 1100 and the rear plate 1200 are provided at the vertical centerlines thereof with holes 1101 and 1201 for maintaining constant height and spacing, respectively. The hole 1101 of the front plate 1100 is formed in a transversely long rectangular shape so that the fixing plate 2000 can go through the hole 1101, while the hole 1201 of the rear plate 1200 is formed in a circular shape so that the push pin 2001 of the fixing plate 2000 can go through the hole 1201. The upper part of the front plate 1100 is inserted through the plate 210, and the part positioned above the plate 210 becomes a wire fixing portion 1102 with a hole 1103, into which the wire 220 is inserted.

Figure 30:
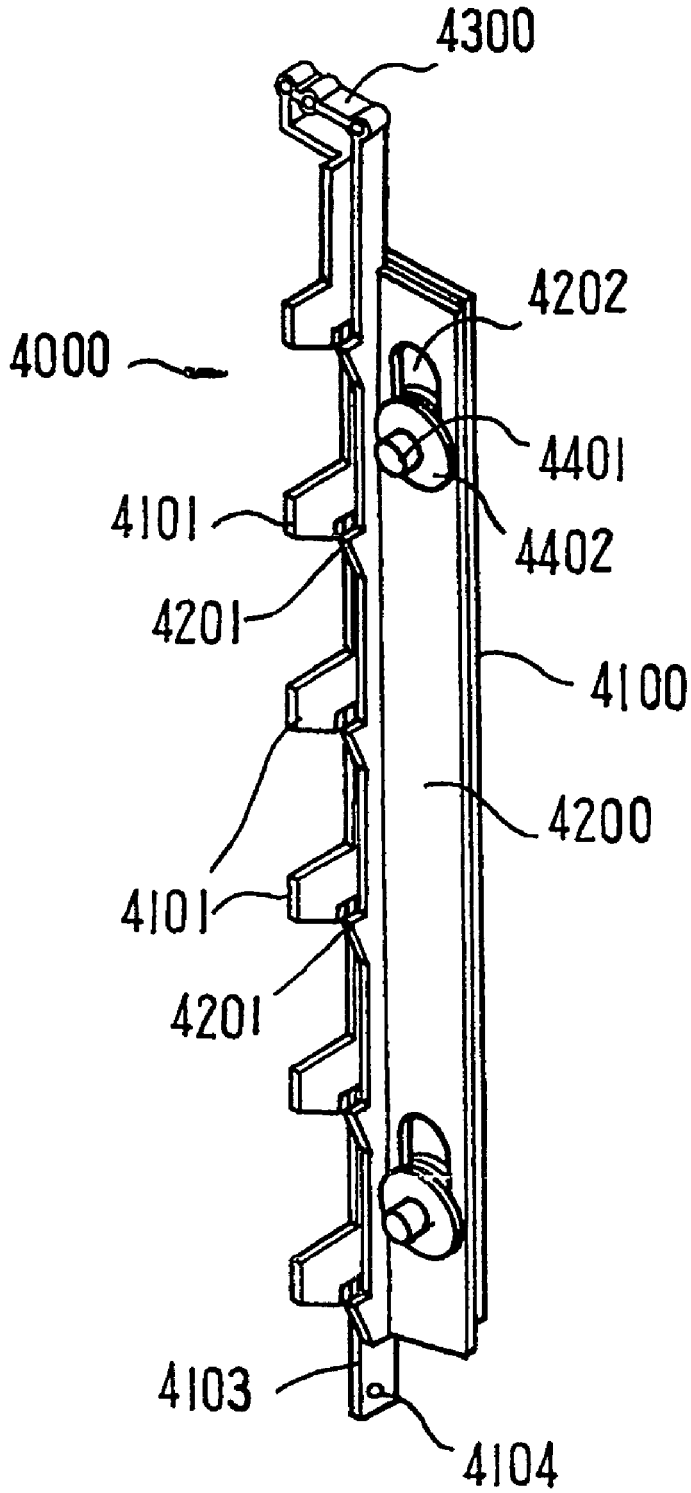
FIG. 30 is a perspective view of a disengagement preventing unit according to the present invention.

The fixing plate 2000 is formed with a rectangular plate with thickness as shown in FIG. 26 and FIG. 27*a*, the front part of which remains inserted in the hole 1101 formed at the front plate 1100, and the push pin 2004 and the latching pin 2005 are placed at right angle to each other to the both sides of the rear part of the fixing plate 2000. To the center of the rear part of the fixing plate is fixed one end of the push pin 2001 of long length. The push pin 2001 goes through the hole 1201 of the rear plate 1200 so that it is exposed to the outside. To the exposed end of the push pin 2001 is attached a button 2002. Between the button 2002 and the rear plate 1200 is arranged a spring 2003. That is to say, the fixing plate 2000 is inserted into the insert hole 311 of the stack 310 by pressing the button 2002. When it is inserted into the insert hole 311, the push pin 2004 pushes a pushing plate 3101 of the safety unit 3000, and a latching pin 2005 is inserted between an upper hook 4101 and a lower hook 4201 of the disengagement preventing unit 4000 as shown in FIG. 30.

When the fixing plate 2000 is disengaged from the insert hole 311 of the stack 310, load of all weights is applied to the safety unit 3000, which comprises a rotating bar 3100 mounted vertically to the upper and lower plates 1300 and 1400, and a support bar 3106 placed at the lower part of the fixing unit 1000.

Figure 29:
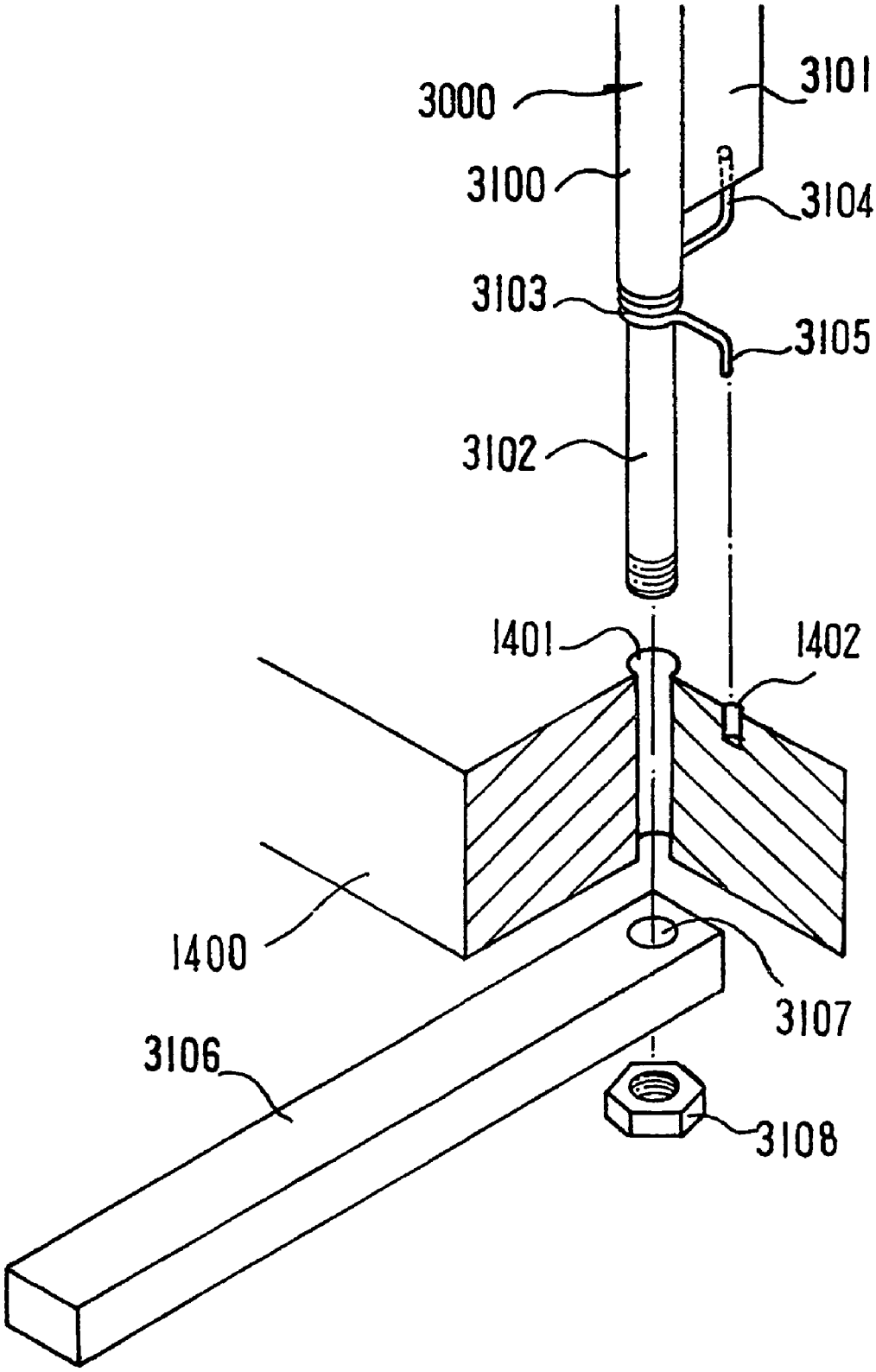
FIG. 29 is a detailed exploded perspective view of the "Z" part in FIG. 25.

In the bottom plate 1400 is formed vertically a through hole 1401 as shown in FIG. 29, and at one side of the through hole 1401 is formed a insert hole 1402. The rotating bar 3100 is provided at the lower end thereof with an insert shaft 3102. The rotating bar 3100 and the insert shaft 3102 have the same center. The insert shaft 3102 goes through the through hole 1401 above the outside. The through shaft 3102 positioned above the outside goes through the hole 3107 of the support bar 3106, and then fixed by means of a nut 3108.

Onto the insert shaft 3102 is arranged a spring 3103 with a latching end and an insert end extending in the opposite directions to each other. The latching end 3104 is placed in the inner part of the pushing plate 3101, and the insert end 3105 is inserted into the insert hole 1402 of the bottom plate 1400. That is to say, when the push pin 2004 of the fixing plate 2000 pushes the pushing plate 3101, the rotating bar 3100 rotates by the distance, and the support bar 3106 is disengaged form the lower part of the stack 310. When the fixing plate 2000 is disengaged from the insert hole 311 of the stack 310, the support bar 3106 is returned to its original state by virtue of the spring force of the spring 3103 so that the support bar 3106 is placed at the lower part of the stacks 310. As a result, all the weights are applied to the support bar to prevent the user from hurting himself by any safety accident, which may occur when training in a defenseless state under the conditions that the fixing plate 2000 is disengaged.

Figure 31:
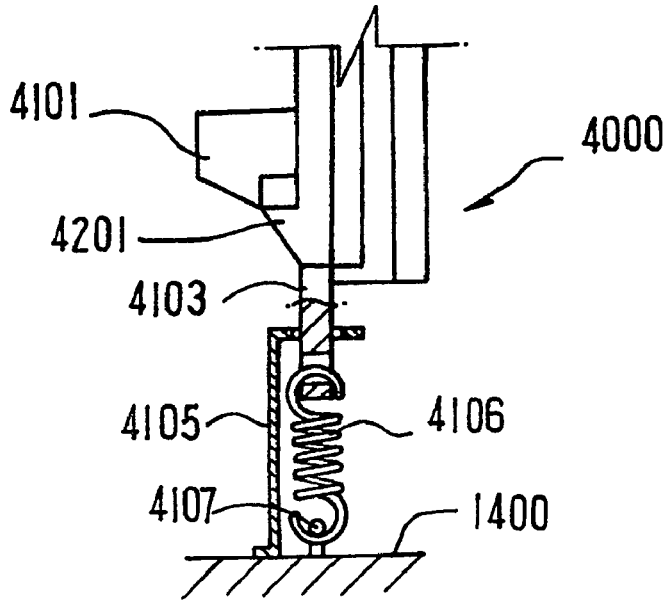
FIG. 31 is a detailed view of the "Y" part in FIG. 25.

The disengagement preventing unit 4000 is provided for preventing the fixing plate 2000 from escaping out of the insert hole 311 of the stack 310. As shown in FIG. 30, a upper hook plate 4100 having a upper hook 4101 and a lower hook plate 4200 having a lower hook 4201 are formed overlapped at regular spacing. At the upper part of the plate connected between the upper hook 4101 and the lower hook 4201 is formed a seesaw part 4300, and an actuating plate 4103 placed at the lowest part of the upper hook 4101 is inserted through a stand 4105, which is mounted vertically to the bottom plate 1400 as shown in FIG. 31. At the actuating plate 4103 is formed a hole 4104, into which the upper part of the spring 4106 latched at the lower part of a fixing hook 4107 attached to the bottom plate 1400 is engaged.

Figure 32:
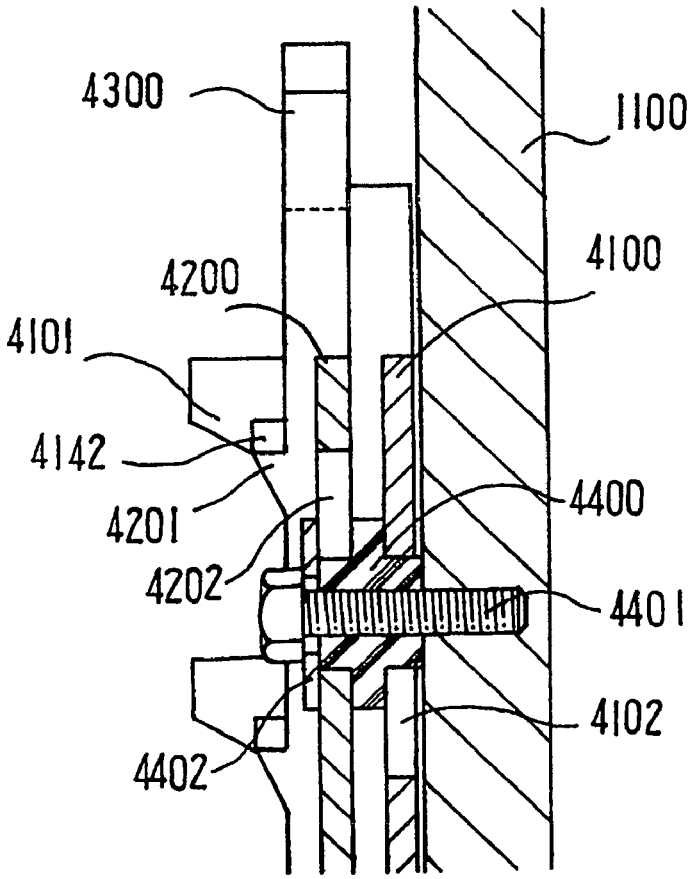
FIG. 32 is a cross sectional view of essential components of a disengagement preventing unit according to the present invention.
Figure 33:
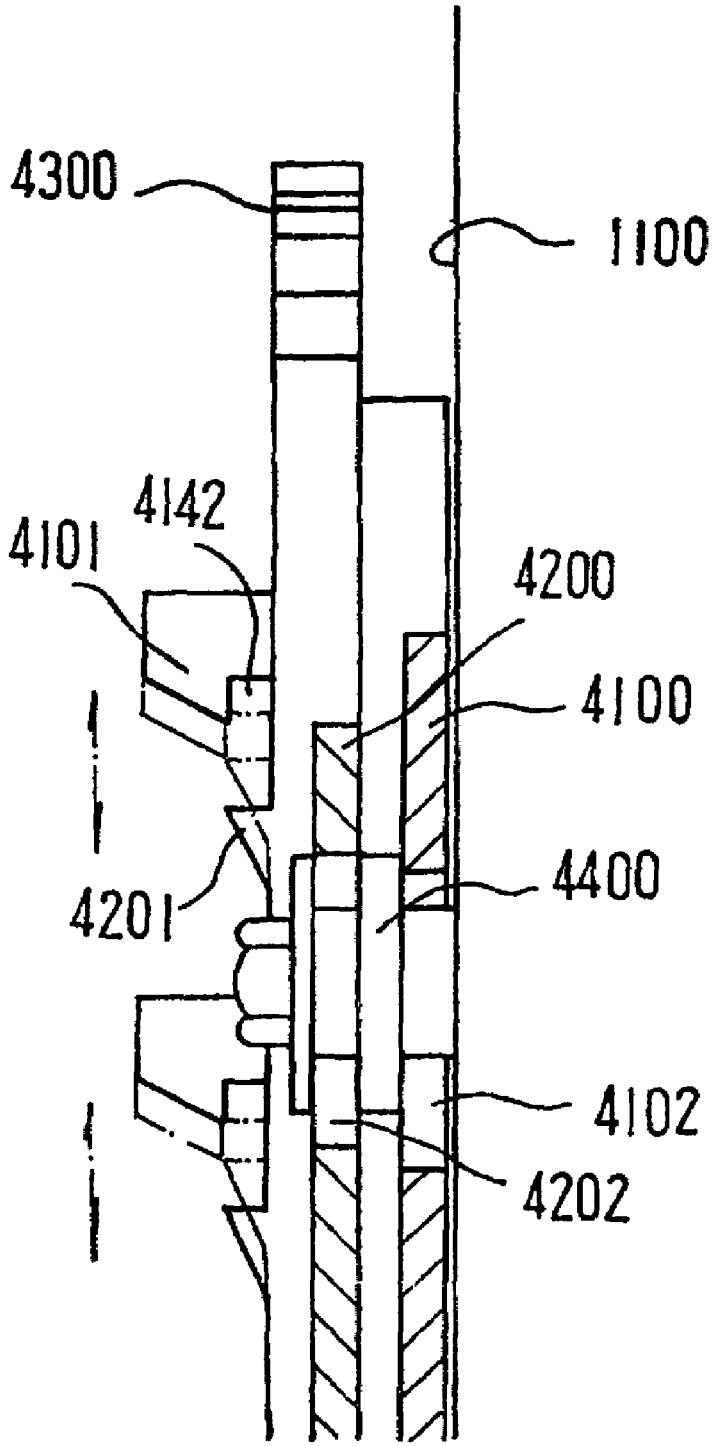
FIG. 33 is a view showing the operation of a disengagement preventing unit according to the present invention.

At the upper and lower hook plates 4100 and 4200 are formed actuating holes of track shape as shown in FIG. 32, which are biased to each other, and a spacer 4400 of a cross shape is arranged between the holes. And the upper and lower hook plates 4100 and 4200 are fixed to each other by means of a bolt 4401 going through the spacer 4400. Consequently, the actuating distances of the upper hook plate 4100 and the lower hook plate 4200 are limited by means of the spacer 4400, and the upper hook plate 4100 and the lower hook plate 4200 are actuated elastically by means of the spring 4106. In the above description, the upper hook 4101 is latched while it protects the front part, the rear part and the top part of the latching pin 2005, and the upper hook 4201 supports the lower part of the latching pin 2005 so that the latching pin 2005 is latched under the condition that the upper and lower hooks 4101 and 4201 cooperated.

Figure 27B:
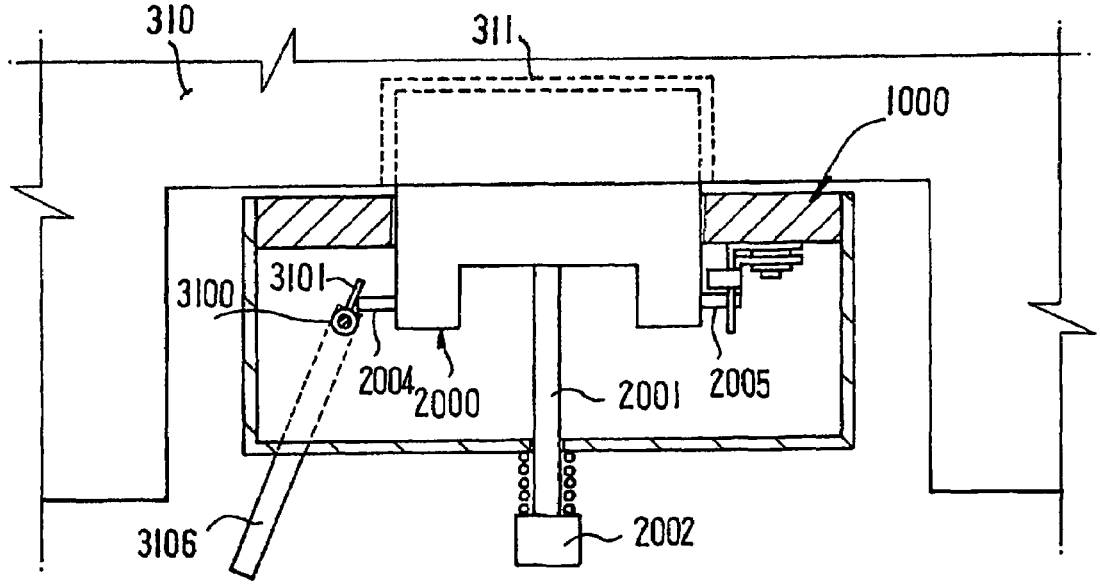
FIG. 27*b* is a view showing an operational state of a fixing plate according to the present invention.
Figure 28B:
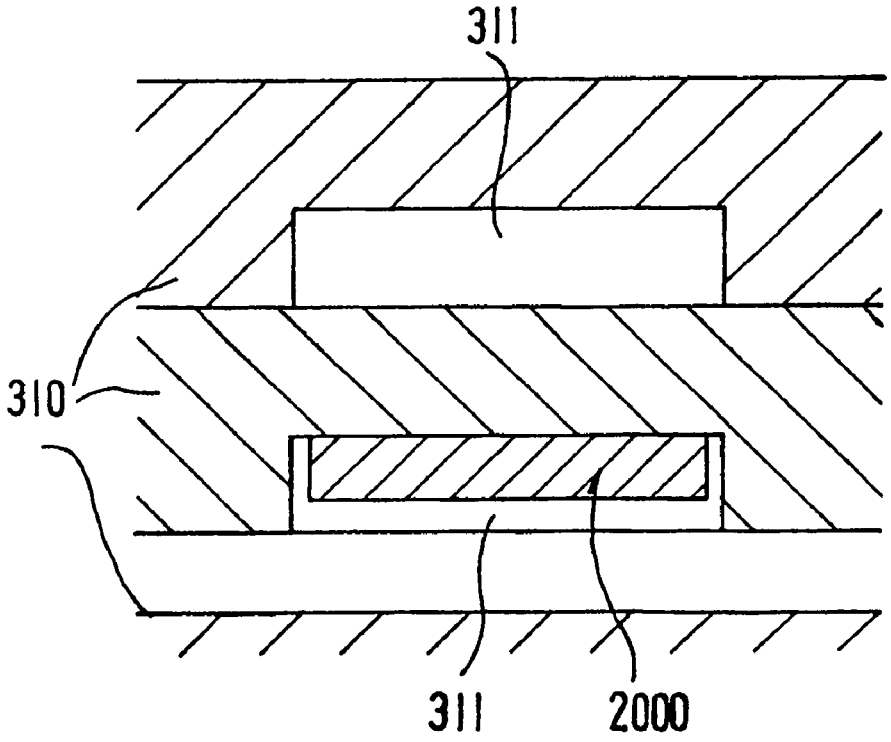
FIG. 28*b* is a view showing a state that a stack is lifted up under the condition of FIG. 28*a;*
Figure 28C:
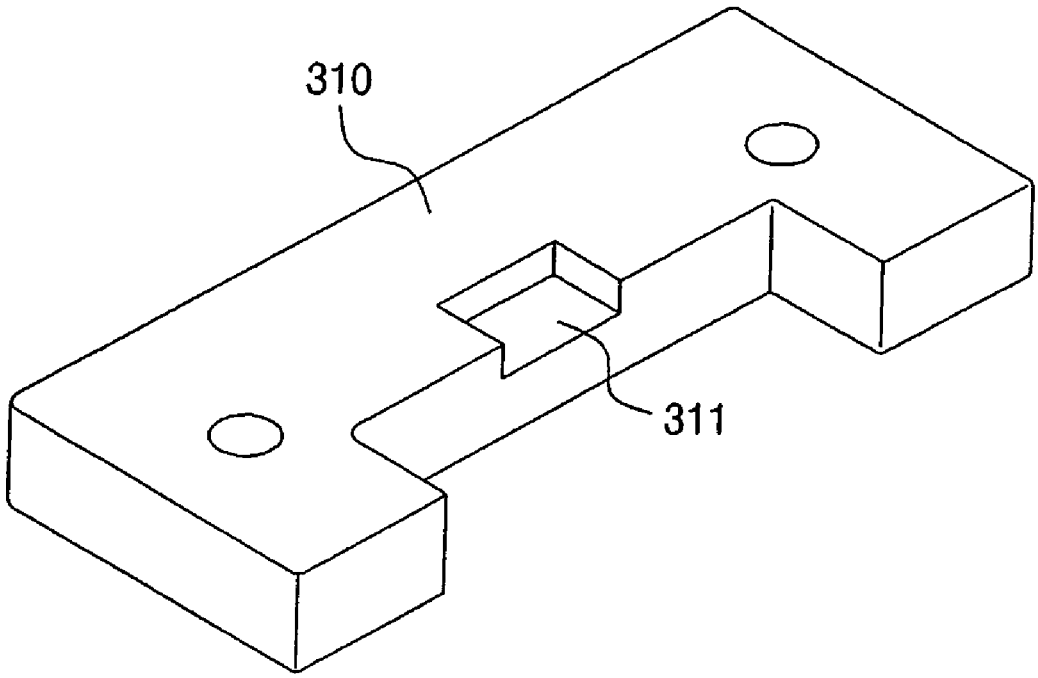
FIG. 28C is a specific elevational view of a stack in FIG. 28A and FIG. 28B.

With the fixing unit 1000 constructed as described above, an exerciser can press the button 2002 corresponding to the stack 310 of the desired weight to take exercise under the condition as shown in FIG. 24 to FIG. 26, as follows:

a) When the button 2002 is pressed, the front part of the fixing plate 2000 is inserted into the insert hole 311 of the stack 310 as shown in FIG. 27*b*. At this time, the fixing plate 2000 can be inserted into the insert hole 311 without any interference with the front face, the both side faces and the top face of the insert hole 311 b) Subsequently, when the exerciser begins to take exercise, the fixing plate 2000 lifts up the stack 310 of the desired weight while it is in contact with the top face of the insert hole 311 as shown in FIG. 28*b*. When the stack is put down again, the fixing plate 2000 do not come in contact with the upper part of the stack 310 placed below the lifted stack of the desired weight so that no impact is transmitted to the fixing plate 2000.

c) Under the condition as in the above paragraph a), the push pin 2004 of the fixing plate 2000 pushes the pushing plate 3101 of the safety unit 3000 as shown in FIG. 27*b*, so that the support bar 3106 connected to the insert shaft 3102 of the rotating bar 3100 is disengaged from the lower part of the lowest stack 310. Consequently, the exerciser can lift up the stack 310 of the desired weight.

d) If the fixing plate 2000 is disengaged from the insert hole 311, the rotating bar 3100 is returned to its original state by virtue of the spring force of the spring 3013 so that the support bar 3106 can be placed at the lower part of the lowest stack 310. Consequently, all stacks 310 of the whole weight are lifted up even if the exerciser do not know it, and thus the exercise can be stopped in a moment.

e) Under the condition as in the above paragraphs a) and c), The latching pin 2005 of the fixing plate 2000 gets in pushing the upper hook 4101 of the disengagement preventing unit 4000. At this time, the upper hook 4101 is pushed upward so that the latching pin 2005 is inserted into the latching portion 4142 between the upper and lower hook 4101 and the 4201.

f) As the upper hook 4101 is pushed upward as in the above paragraph e), one side of the seesaw portion 4300 (the part connected to the connecting plate of the upper hook 4101) is moved upward, and subsequently the part connected to the connecting plate of the lower hook 4201 is moved downward so that the upper and lower hook plates 4100 and 4200 are actuated up and down biased to each other. Here, the lower hook 4201 is moved two times as long as the upper hook 4101.

g) In the above paragraph f), if the upper hook 4101 is moved a distance corresponding to 1 and then returned to its original position, the lower hook 4201 is moved a distance corresponding to 2 and then returned to its original position. It is because another stack 310 of different weight is selected and the fixing plate 2000 is inserted into the insert hole 311 of the stack 310, and thus the latching pin 2005 of the fixing plate 2000, which has already been inserted, can be disengaged smoothly from the corresponding upper and lower hooks 4101 and 4201.

h) Consequently, no safety accident will not occur when the exerciser select the stack 310 of the desired weight. If the fixing plate 2000 is disengaged from the insert hole 311 of the stack 310, load is applied to all weights of the stacks 310 by means of the safety unit 3000. Before that, however, the latching pin 2005 of the fixing plate 2000 is placed under more stabilized conditions by virtue of the cooperation of the upper and lower hooks 4101 and 4201, thereby preventing the fixing plate 2000 from escaping spontaneously. In the drawings, the unexplained reference numeral 4402 indicates a washer.

Figure 34:
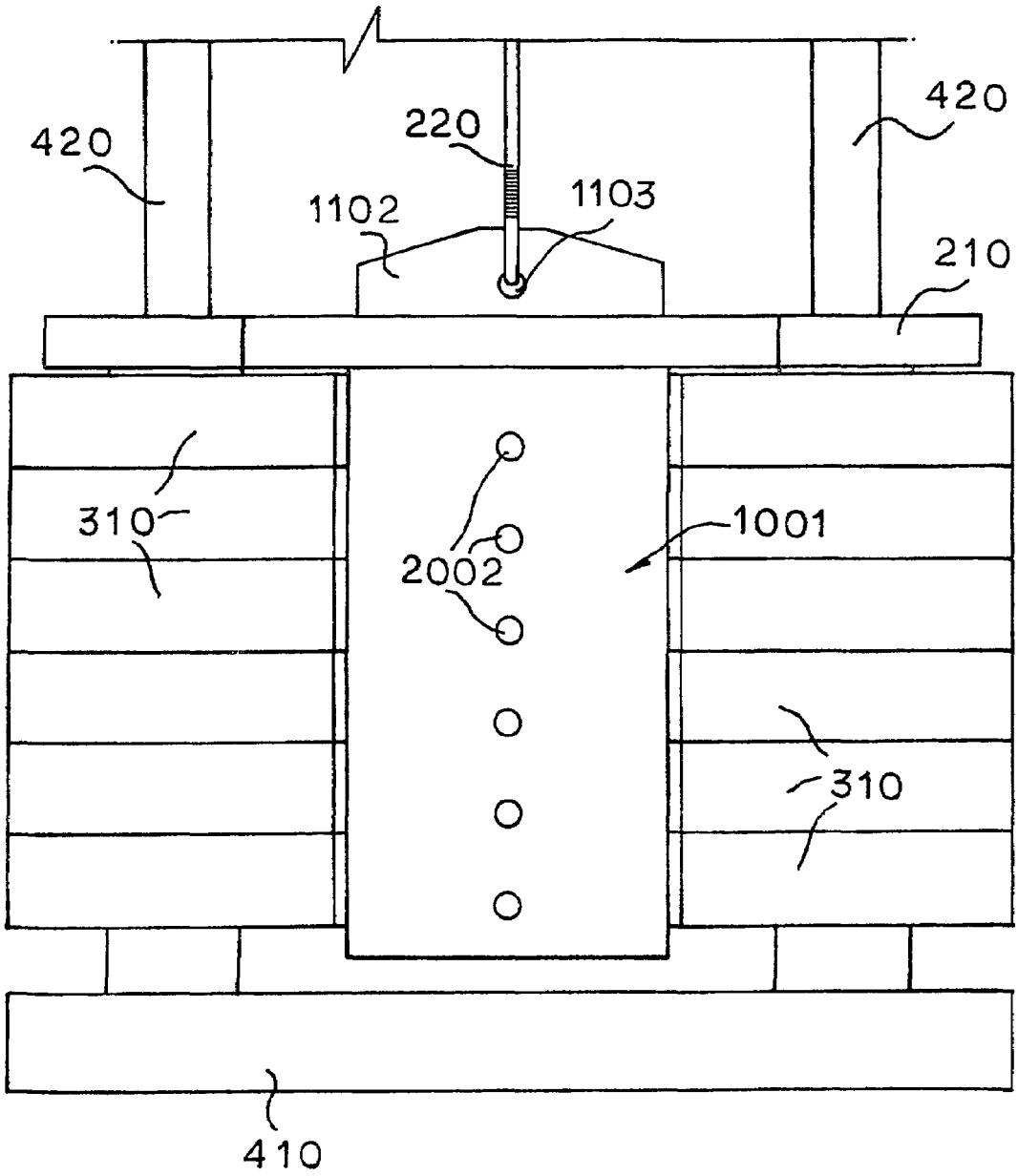
FIG. 34 is a front elevational view of a weight training machine according to still another preferred embodiment of the present invention.
Figure 35:
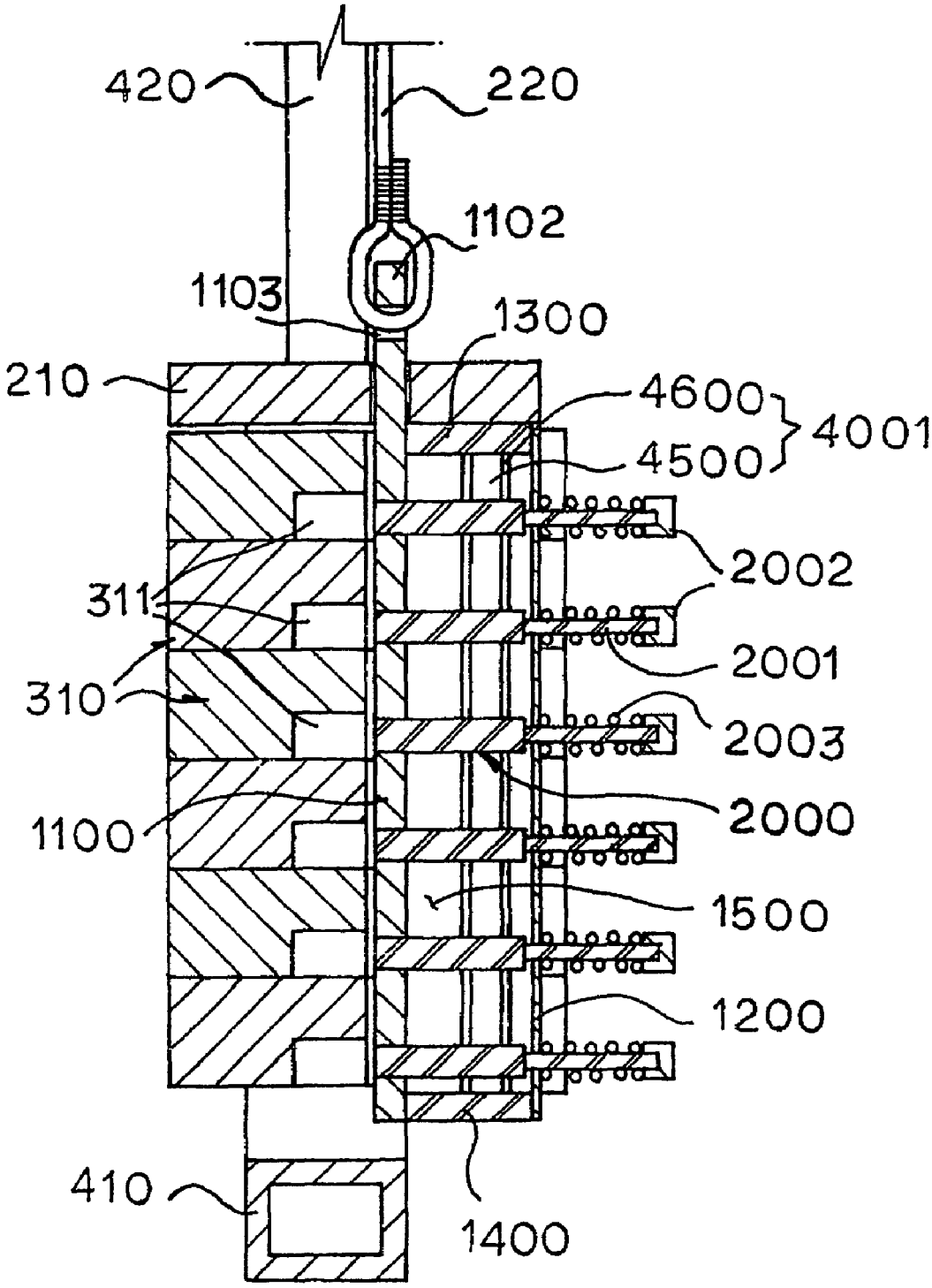
FIG. 35 is a sectional side view of a weight training machine according to the present invention.

FIG. 34 and FIG. 35 show a device for controlling weight of the weight training machine according to the present invention. In the fixing unit 1001 mounted to the front center of the stacks 310 is provided the disengagement preventing unit 4000.

At the side of the depressed part of the stack 310 is formed an insert hole 311, through which a fixing plate 2000 of a fixing unit 1001 is inserted, which will be described below.

Figure 36A:
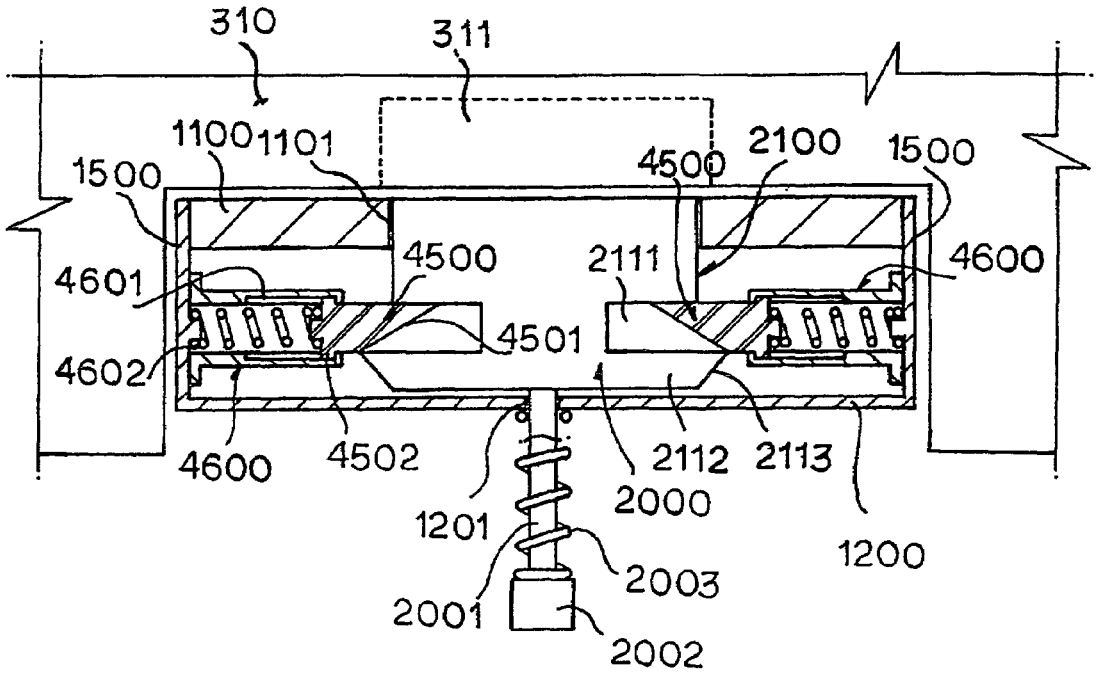
FIG. 36*a* is a sectional plan view of a fixing unit according to the present invention, showing a state before its operation.
Figure 36B:
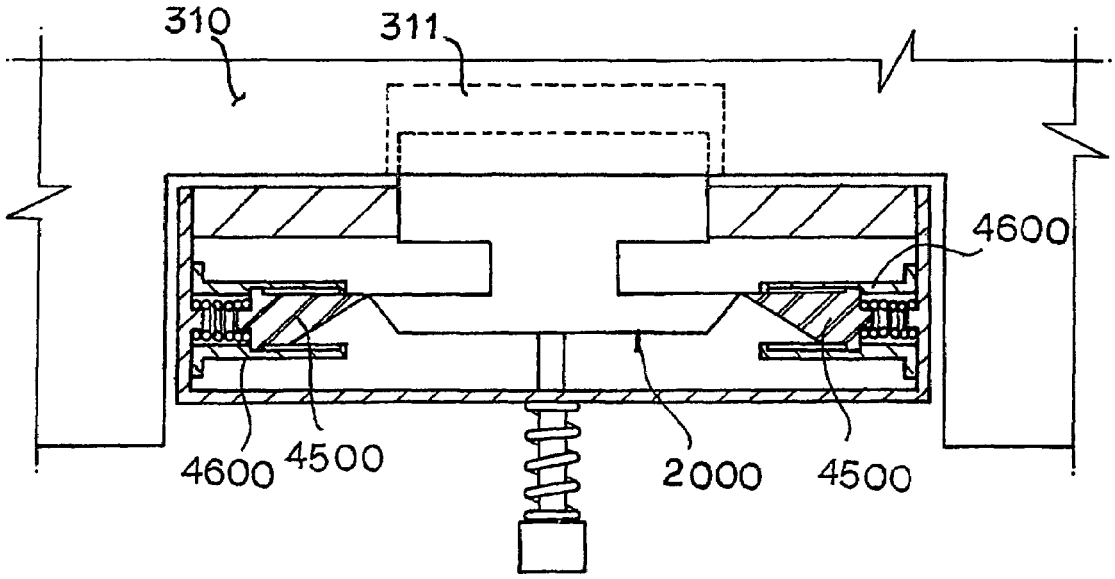
FIG. 36*b* is a sectional plan view of a fixing unit according to the present invention, showing a state during its operation.

The stack 310 is provided at the center of gravity thereof with an insert hole 311 of rectangular shape, as shown in FIG. 36*a* and FIG. 28*a* The insert hole 311 has two side faces, a front face and a top face, which all are closed by the stack 310 itself, and a face forming the entrance and a bottom face, which are open.

The fixing unit 1001 is placed at the depressed part of the stack 310. As shown in FIG. 35 and FIG. 36*a*, the fixing unit 1000 constitutes a cylindrical body of rectangular shape by a front plate 1100, a rear plate 1200, side plates 1500, a top plate 1300 and a bottom plate 1400.

The front plate 1100 and the rear plate 1200 are provided at the vertical centerlines thereof with holes 1101 and 1201 for maintaining constant height and spacing, respectively. The hole 1101 of the front plate 1100 is formed in a transversely long rectangular shape so that the fixing plate 2000 can go through the hole 1101, while the hole 1201 of the rear plate 1200 is formed in a circular shape so that the push pin 2001 of the fixing plate 2000 can go through the hole 1201. The upper part of the front plate 1100 is inserted through the plate 210, and the part positioned above the plate 210 becomes a wire fixing portion 1102 with a hole 1103, into which the wire 220 is inserted.

The fixing plate 2000 is formed with a rectangular plate with thickness as shown in FIG. 35 and FIG. 36*a* A front stationary part 2100 remains inserted in the hole 1101 formed at the front plate 1100, and a rear actuating part 2112 is provided at the both sides thereof with sloping portions 2112. Furthermore, between the front stationary part 2100 and the rear actuating part 2112 are formed grooves 2111 at the both sides thereof.

In other words, the fixing plate 2000 is formed of a rectangular plate shape, which comprises the front stationary part 2100 formed at the front thereof, the rectangular grooves 2111 formed at the both end in the central position, and the actuating part 2112 with the sloping portion 2113 formed at the rear thereof. The sloping portions 2113 of the actuating part 2112 has a sloping surface widening gradually toward the insert hole 311 of the stack 310.

To the rear surface of the actuating part 2112 is attached one end of the pushing pin 2001 at the center thereof. The pushing pin 2001 goes through the hole 1201 of the rear plate 1200 and then is exposed to the outside, and to the exposed end of the pushing pin 2001 is attached the button 2002. Between the button 2002 and the rear plate 1200 is arranged the spring 2003. That is to say, the fixing plate 2000 is inserted into the insert hole 311 of the stack 310 by pressing the button 2002. When the fixing plate 2000 is inserted into the insert hole 311, the sloping portion 2113 at the both sides of the actuating part 2112 widens the disengagement preventing plate 4500 of the disengagement preventing unit 4001. After widened, the disengagement preventing plate 4500 is placed at one side of the actuating part 2112, thereby preventing the fixing plate 2000 from escaping out of the insert hole 311.

The disengagement preventing unit 4001 is attached opposite to each other at the inner side of the both side plates 1500 of the fixing unit 1001, which comprises a disengagement preventing plate 4500 and a guide 4600.

To one side of the disengagement preventing plate 4500 is formed a sloping portion 4501, which has a sloping surface opposite to the sloping surface 2113 of the actuating part 2112. To the other side of the disengagement preventing plate 4500 is formed a stopper 4502. That is to say, the disengagement preventing plate 4500 is directed to the groove 2111 of the fixing plate 2000, and at the same time it is formed with the same width as the groove 2111 and height between the upper and lower plates 1300 and 1400.

The guide 4600 is formed of cylindrical body, one side of which is fixed to side plate 1500 and the other side of which is open. At the inner side of the entrance is formed a stopper rail 4601, into which the stopper 4502 of the disengagement preventing plate 4500 can be inserted. Between the part fixed to the side plate 1500 and the disengagement preventing plate 4500 is arranged a spring 4602. Consequently, since the stopper 4502 is connected to the stopper rail 4601 of the guide 4600, the distance that the disengagement preventing plate 4500 is advanced and retreated is limited, and the motion that the disengagement preventing plate 4500 is advanced and retreated is not fluctuated.

Figure 36C:
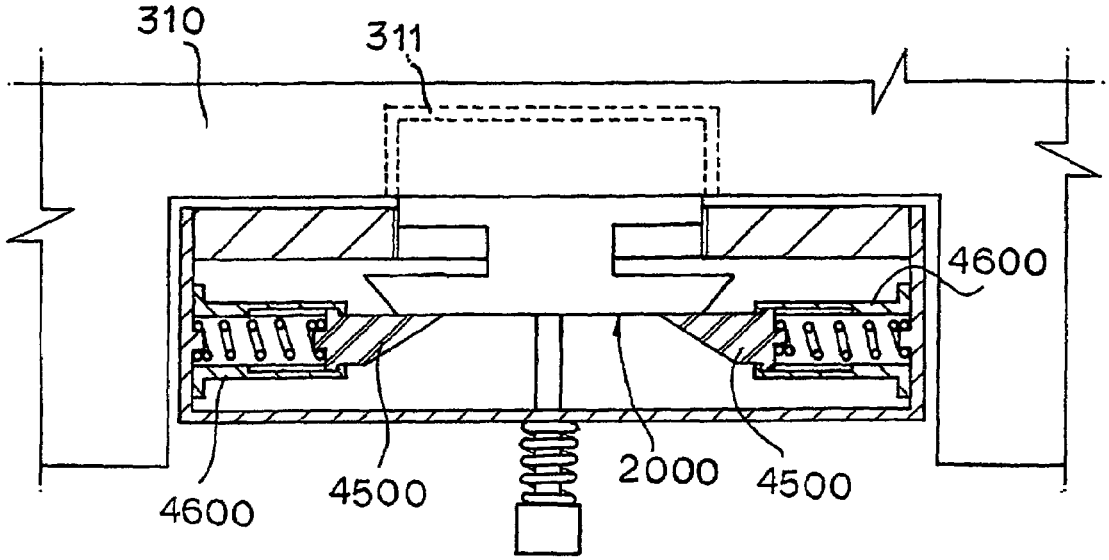

With the weight training machine according to the present invention constructed as described above, the exerciser can push the button 2002 corresponding to the stack 310 of the desired weight among the several stacks 310 to take exercise under the conditions as shown in FIG. 34 and FIG. 35. At the position that the disengagement preventing plate 4500 is placed in the groove 2111 of the fixing plate 2000 as shown in FIG. 36*a*, if the button 2002 is pressed, the fixing part 2100 of the fixing plate 2000 is inserted into the insert hole 311 of the stack 310 by means of the pushing pin 2001 as shown in FIG. 36*c*. Consequently, the fixing plate 2000 remains fixed by means of the disengagement preventing plate 4500 so that the fixing plate 2000 can be prevented from escaping out of the insert hole 311 of the stack 310.

The fixing part 2100 of the fixing plate 2000 in inserted into the insert hole 311 without any interference with the front face, the both side faces and the top face of the insert hole 311, as shown in FIG. 36*a* and FIG. 28*a*. Subsequently, when the exerciser begins to take exercise, the fixing part 2100 lifts up the stack 310 of the desired weight while it is in contact with the top face of the insert hole 311 as shown in FIG. 28*b*. When the stack is put down again, the fixing part 2100 do not come in contact with the upper part of the stack 310 placed below the lifted stack 310 of the desired weight so that no impact is transmitted to the fixing plate 2000.

In the above description, a) while the fixing plate 2000 is placed under the conditions as shown in FIG. 36*a*, that is to say while the disengagement preventing plate 4500 is placed in the groove 2111 of the fixing plate 2000, b) if the button 2002 is pressed, the disengagement preventing plate 4500 is widened to the both sides thereof by means of the actuating part 2112. At this time, the disengagement preventing plate 4500 is widened gradually and at the same time it is inserted into the guide 4600.

c) Subsequently, the fixing part 2100 of the fixing plate 2000 is inserted into the insert hole 311 as shown in FIG. 36*c*, and at the same time the disengagement preventing plate 4601 inserted in the guide 4600 is returned to its original position by virtue of the spring force of the spring 4602. As a result, the disengagement preventing plate 4601 is placed while it is in contact with one side of the actuating part 2112, so that disengagement of the fixing plate 2000 from the insert hole 311 is prevented.

d) Subsequently, if the button corresponding to the stack 310 of different weight is pressed, the fixing plate 2000 corresponding to the different weight is placed under the same conditions as in the above paragraphs b) and c), and the fixing plate 2000 inserted in the insert hole 311 of the stack 310 is disengaged as the fixing plate 2000 of the different weight widens the disengagement preventing plate 4500.

e) Consequently, no safety accident will not occur when the exerciser select the stack 310 of the desired weight. In addition, the fixing plate 2000 is placed under more stabilized conditions by virtue of the disengagement preventing plate of the disengagement preventing unit 4000, thereby preventing the fixing plate 2000 from escaping spontaneously.

Figure 37:
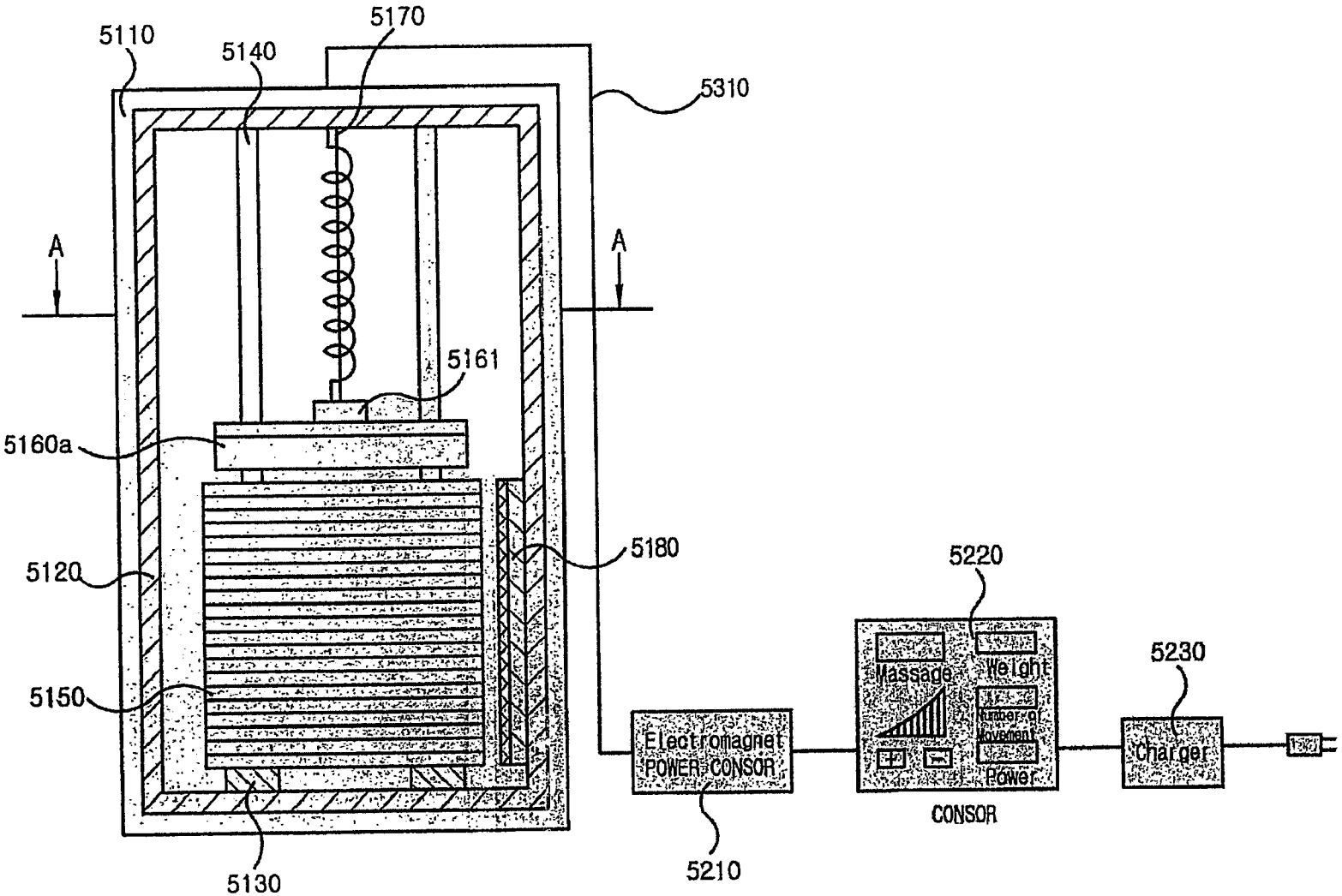
FIG. 37 is a view showing the entire structure of a weight training machine according to still another preferred embodiment of the present invention.
Figure 38:
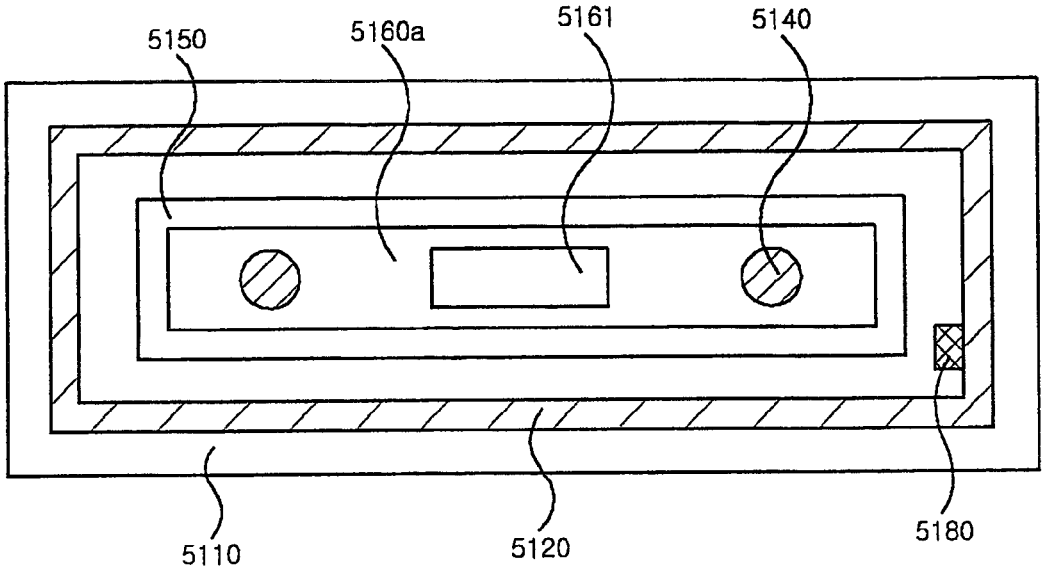
FIG. 38 is a sectional plan view taken along the line A-A of FIG. 3.
Figure 39:
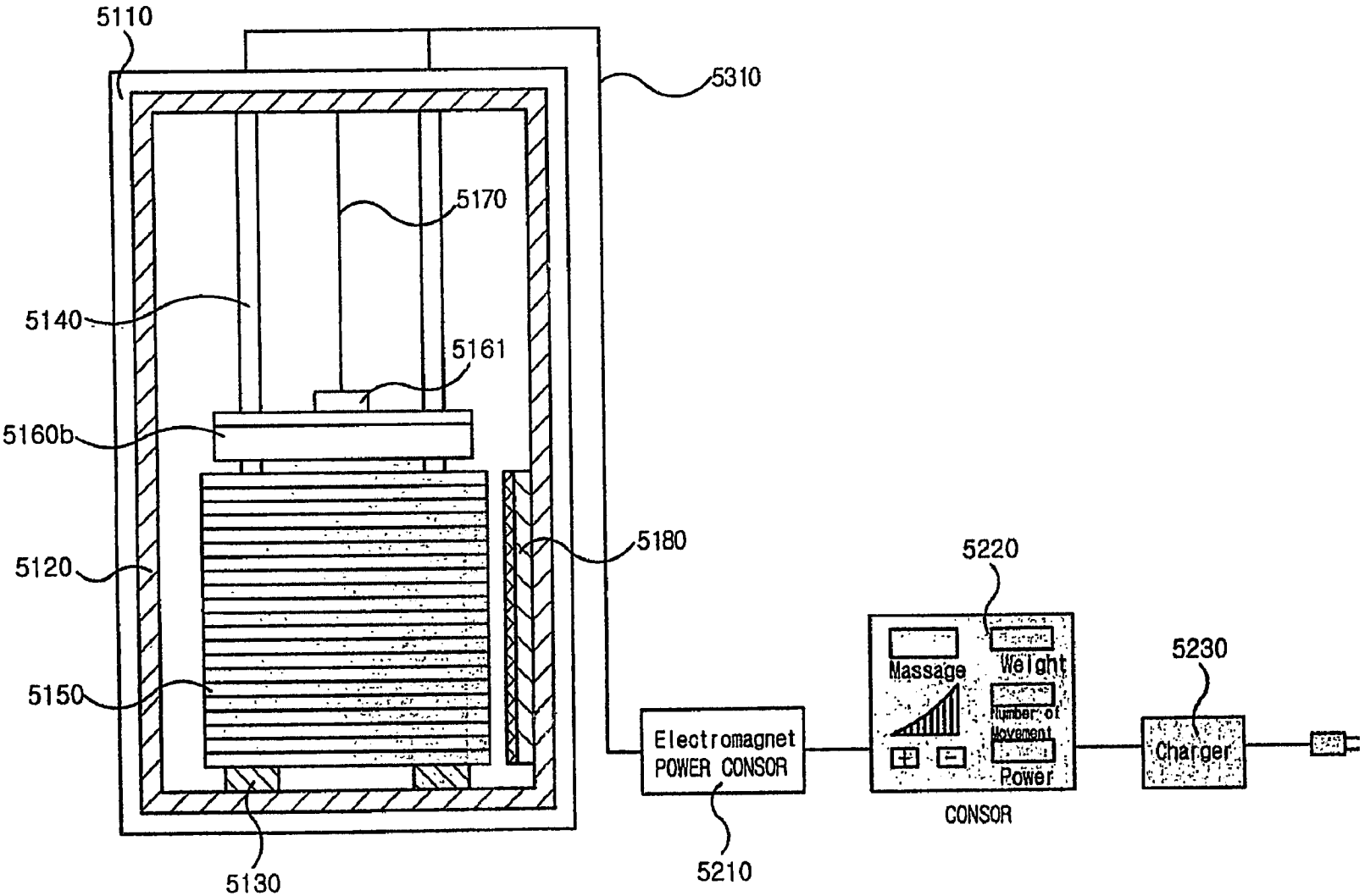
FIG. 39 is a view showing the entire structure of a weight training machine according to still another preferred embodiment of the present invention.

The structure of the device for controlling weight of the weight training machine according to the present invention will now be described with reference to FIG. 37 to FIG. 39.

First of all, in the same manner as in the conventional weight training machine, guides 5140, which go through stacks 5150 and along which the stacks 5150 move up and down, are mounted fixedly to the upper part of a base 5130. The lower part of the base 5130 and the upper part of the guides 5140 are fixed by means of a frame 5110. And inside of the frame 5110 is attached an insulator 5120 for preventing a leakage of electricity from the power source applied to an electromagnet 5160*a*, which will be described below, and for preventing an electromagnet field generated by the operation of the electromagnet 5160*a* from leaking out to the outside. Also, at one inner side of the frame 5110 is attached vertically a sensor 5180 for sensing the position of the stack 5150.

To the guides 5140 is attached the stacks 5150, as described above. To the upper part of the stack 5150 is attached the electromagnet 5160*a* with a fixing member 5161, to which the wire is connected, at regular spacing. The electromagnet 5160*a* is combined so that it is pulled upward by means of a wire 5170. It should be understood that the handle part for pulling the wire 5170 is omitted for the purpose of illustrating the device according to the present invention more clearly. The omitted handle part is the same as that of the conventional weight training machine.

The power is supplied the electromagnet 5160*a* via a power input line 5310, and the electromagnet 5160*a* is connected to a power controller 5210 for controlling the strength of the magnetic force of the electromagnet 5160*a* via a power input line 5310 (that is to say, for controlling the strength of the current inputted to the electromagnet). The power controller 5210 is connected to a controller 5220 for controlling the power controller 5210 of the stack 5150, which includes a display part (not shown) for displaying messages such as warning, weight of the stack, and the number of movement. Also, to the controller 5220 is connected a charger 5230 for supplying power temporarily to prevent any safety accident if the power is shut off due to interruption of the electric power or the like.

In the above mentioned embodiment of the present invention, the power input line 5310 is connected directly to the electromagnet 5160*a* in order to supply electric power for generating the magnetic force to the electromagnet 5160*a*, although the power input line 5310 may be connected to the guides 5140 so that the electric power can be supplied to the electromagnet 5160*b* via the guides 5140, as shown in FIG. 5. That is to say, the power is supplied to the electromagnet 5160*b* in the contact configuration. In other words, in case that the electric power is supplied in the contact configuration, a brush is provided in the electromagnet 5160*b* using a principle similar to that of an electromotive vehicle, and the electric power is supplied even while the electromagnet 5160*b* is moved up and down along the guides 5140 through the brush.

Figure 40:
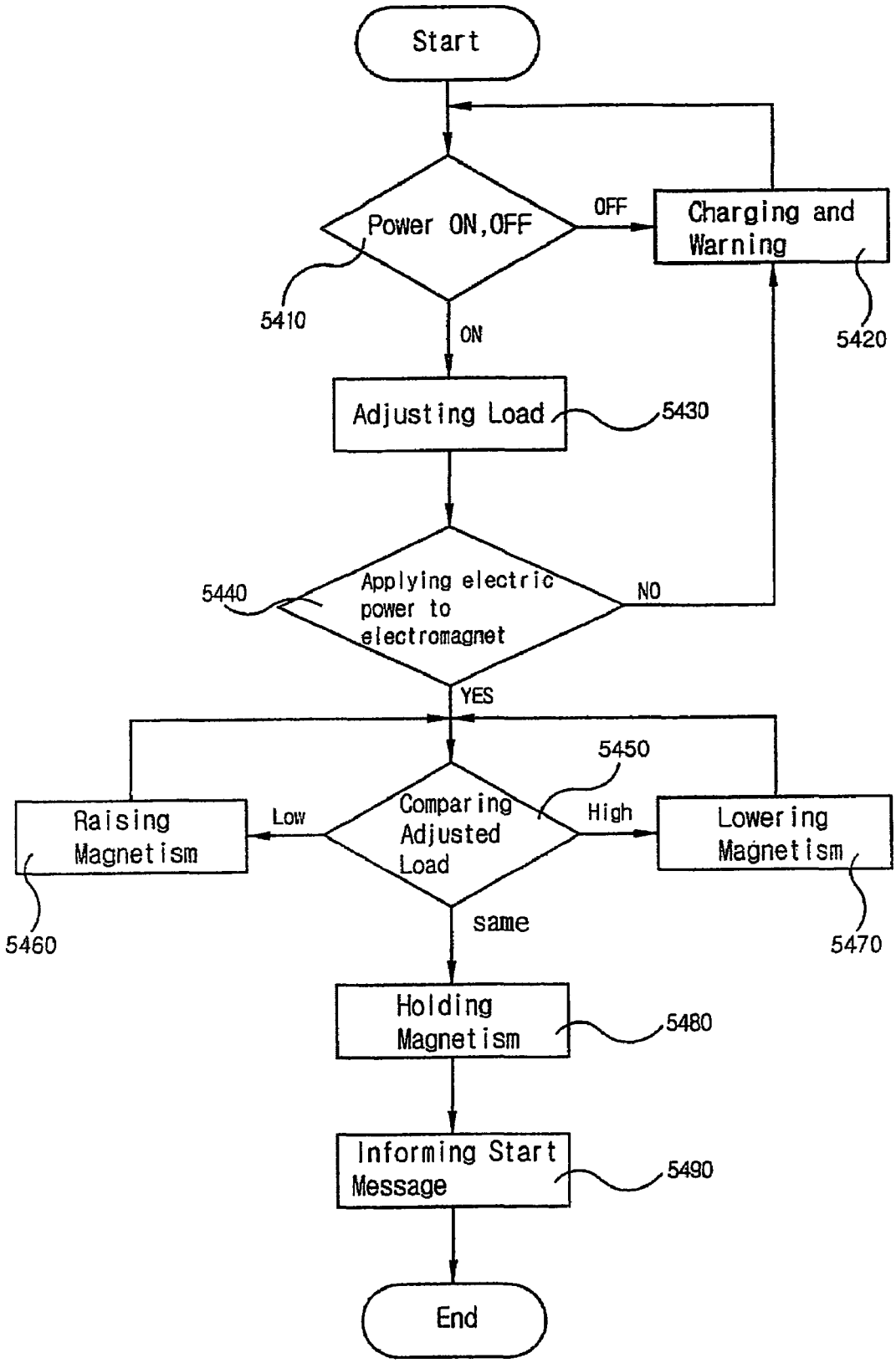
FIG. 40 is a flow diagram of a weight training machine according to the present invention.

With the weight control device constructed as mentioned above, the weight is controlled by means of the method as shown in FIG. 40. At Step 5410, it is checked whether the electric power is supplied through the controller 5220 while the electric power is supplied to the weight control device. The reason why it is checked whether the electric power is applied normally is because the stacks 5150 of the predetermined weight are lifted up using the electromagnets 5160*a* and 5160*b* and this any abnormal supply of the electric power may cause any safety accident.

If the electric power is off at Step 5410, an electric charging operation is carried out by means of the charger, and at the same time it is informed through the display of the controller 5220 that the power has been applied. By virtue of such an electric charging, the power can be supplied temporarily to prevent any safety accident even if the power is shut off due to interruption of the electric power or the like when the weight training machine is used.

If the electric power is applied normally at Step 5410, the user can adjust load of the stack 5150 with the desired weight to take exercise through the controller 5220 at the next step (Step 5420). The value corresponding to the weight set by the user is supplied as the strength of the required current through the power controller 5210, and the magnetic force of the electromagnets 5160*a* and 5160*b* is controlled so that the stacks 5150 of the weight corresponding to it are attached to the electromagnets 5160*a* and 5160*b*.

If the load is adjusted at Step 5420, it is checked again that the electric power is applied to the electromagnets at the next step (Step 5430). Checking again whether the electric power is applied to the electromagnets is necessary for preventing any safety accident as mentioned above.

If the electric power is not applied to the electromagnets at Step 5430, the process is advanced to a charging and warning step (Step 5420) and the abnormal operation is informed to the user. It the electric power is applied normally, the value of the load set by the user is compared with the value of the weight of the stacks lifted up by means of the electromagnets 5160*a* and 5160*b*.

The value of the set load and the value of the weight of the stacks attached to the electromagnets are checked by means of the sensor 5180. That is to say, if a certain number of stacks 5150 are attached to the electromagnets by virtue of the magnetic force of the electromagnets, spacing occurs between the electromagnets and the unattached stacks because the electromagnets and the stacks are separated apart from each other. The position of such spacing is sensed by means of the sensor 5180 so that the weight of the stacks attached to the electromagnets can be confirmed, and the confirmed weight of the stacks is compared with the set value of the load.

If the measured value of the weight of the stacks is lower than the set value, the process is advanced to a magnetism raising step (Step 5460), at which the strength of the current supplied through the power controller 5210 is compensated to reinforce the magnetic force, and then the value of load is compared again.

On the contrary, if the measured value of the weight of the stacks is higher than the set value, the process is advanced to a magnetism lowering step (Step 5470), at which the strength of the current supplied through the power controller 5210 is compensated to reinforce the magnetic force, and then the value of load is compared again.

After going through the process as mentioned above, if the set value and the measured value is the same, the process is advanced to a magnetism holding step (Step 5480), at which the strength of the current supplied through the controller 5220 is maintained constant, and then the process is advanced to the next step (Step 5490), at which it is informed of the user that it is ready for using the machine through the display of the controller 5220. After going through the process as mentioned above, the user can control the weight of the stack in real time so that the most suitable environment for exercise is maintained.

Besides, it is possible to reduce thickness of the stack not more than 5 mm, and to adjust weight of the stack by unit of 1 kg so that the exerciser can take exercise while he or she adjusts minutely the weight of the stack depending on with his or her current conditions.

INDUSTRIAL APPLICABILITY

The device for controlling weight of the weight training machine according to the present invention has the following effects.

It is possible to control remotely weight of the stack, and to check and adjust the weight easily. The coupling state between the stacks and the fixing bar is maintained stable so that any safety accident can be prevented. It is possible to build in various programs with automatic adjusting function of the amount of load, thereby giving a motive for exercise, which brings about interest of the user. Physically handicapped persons or rehabilitants, who need to train with help of assistants, are able to use the weight training machine more conveniently. And more advanced design can be provided. Furthermore, it is possible to control remotely the weight control device, to adjust the weight minutely, and check the weight in real time.

What is claimed is:

1. A variable load weight training machine, comprising a base;

a pair of weight guides having upper and lower ends, the lower ends of the weight guides being mounted to the base;

a plurality of weights slidably attached to the pair of weight guides such that the weights may slide between the upper and lower ends of the weight guides, the weight guides extending along an axis intersecting with an upper side and lower side of each of said weights, each of said weights having a corresponding lateral side extending between the upper and lower side of the weight, the lateral side of each of the weights having a corresponding recessed portion forming an indentation, the recessed portion extending from the upper side to the lower side of each weight, each of said weights having a fixing bar hole extending from the upper side to lower side of the weight, and each of said weights having an insert hole formed in the recessed portion side and extending to the fixing bar hole;

a plate slidably attached to said weight guides such that the plate may slide between the upper and lower ends of the weight guides, the plate being closer to the upper ends of the weight guides than the plurality of weights, the plate having a lower side proximal to the plurality of weights;

a fixing bar with a plurality of holes formed therein, said fixing bar being mounted to the lower side of said plate, the fixing bar being positioned and sized to extend through the fixing bar holes in the weights when the lower side of the plate is in contact with the upper side of the weight closest to the upper ends of the guides;

a pair of fixing unit guides having upper ends mounted to the lower side of the plate, the fixing unit guides positioned and sized to extend in a longitudinal direction, defined by an axis that intersects the upper side and lower side of the weights, through the indentations of the weights when the lower side of the plate is in contact with the upper side of the weight closest to the upper ends of the fixing unit guides, wherein each of said fixing unit guides is provided at the one side thereof with a plurality of stop grooves along its longitudinal direction, a fixing unit slidably attached to the fixing unit guides such that the fixing unit may slide toward and away from the upper ends of the fixing unit guides, said fixing unit having a receiving chamber passing therethrough that aligns with the insert hole of each weight as the fixing unit is slidably moved, said fixing unit having guide holes, the fixing unit guides extending through the guide holes, said fixing unit having a positioning structure hole that extends from an external surface of the fixing unit to one of the guide holes at a location aligned with the stop groove on the fixing unit guide within the one of the guide holes;

a fixing pin provided in the receiving chamber having a first end of the fixing pin distal to the weights and a second end proximal to the weights that is sized and positioned to be inserted into any one of the insert holes when the fixing unit receiving chamber is aligned with the one of the insert holes, the fixing pin being biased toward the insert hole;

a positioning insert provided in the positioning structure hole proximal to and biased toward an end of the positioning structure hole by the one of the guide holes.

2. The variable loadweight training machine of claim 1, further comprising a control unit with a slot shaped guide hole and a plurality of control unit stop grooves formed on a front end surface of the control unit along a longitudinal side of said slot shaped guide hole;

a slider slidably mounted in the slot shaped guide of the control unit, the slider having a through hole extending from a first end of the slider at a front side of the slot shaped guide hole to a second end of the slider at a back side of the slot shaped guide hole, the slider having a flange with a communicating surface opposing the front end surface of the control unit, the flange having a hole in the communicating surface that aligns with the control unit stop grooves as the slider is slidably moved in the slot shaped guide;

an actuating bar provided in the through hole of the slider, the actuating bar having an end on the front side of the slot shaped guide hole with a handle;

a second positioning insert provided in the flange hole and biased toward one of said plurality of stop grooves when said flange hole is aligned with the one of said plurality of stop grooves;

a first cable wire mechanically connected between the slider and the fixing unit so as to translate movement of the slider in the longitudinal direction of the slot shaped guide into movement of the fixing unit along the fixing unit guides;

a second cable wire mechanically connected between the actuating bar and the handle of the fixing pin so as to translate a movement of the actuating bar along an axis that intersects the front side and back side of the slot shaped guide hole into movement of the fixing pin in or out of the insert hole.

3. A variable load weight training machine, comprising a base;

a pair of weight guides having upper and lower ends, the lower ends of the weight guides being mounted to the base;

a plurality of weights slidably attached to the pair of weight guides such that the weights may slide between the upper and lower ends of the weight guides, the weight guides extending along an axis intersecting with an upper side and lower side of each of said weights, each of said weights having a corresponding lateral side extending between the upper and lower side of the weight, the lateral side of each of the weights having a corresponding recessed portion forming an indentation, the recessed portion extending from the upper side to the lower side of each weight, each of said weights having a fixing bar hole extending from the upper side to lower side of the weight, each of said weights having an insert hole formed in the recessed portion side and extending to the fixing bar hole;

a plate slidably attached to said weight guides such that the plate may slide between the upper and lower ends of the weight guides, the plate being closer to the upper ends of the weight guides than the plurality of weights, the plate having a lower side proximal to the plurality of weights;

a fixing unit attached to the plate, said fixing unit extending in a longitudinal direction, defined by an axis that intersects the upper side and lower side of the weights, through the indentations of the weights when the lower side of the plate is in contact with the upper side of the weight closest to the upper ends of the weight guides, the fixing unit having an internal cavity, the fixing unit having a plurality of fixing pin holes extending from an external surface of the fixing unit to the internal cavity, each of the fixing pin holes being part of a set of two fixing pin holes, each set of fixing pin holes corresponding to one of the weights, the fixing pin holes in each set of fixing pin holes being on opposing sides of the internal cavity and aligned with the insert hole of the fixing pin hole set's corresponding weight;

a fixing pin slidably provided in each set of fixing pin holes so as to selectively engage and disengage a first end of the fixing pin proximal to the weights from the insert hole of the weight corresponding to the fixing pin hole set, each fixing pin having a second end distal to the weights.

4. The variable load weight training machine of claim 3, wherein each of said fixing pins is provided with a latching projection and one or more guide projections extending lengthwise along a portion of a side of the fixing pin that extends between the first and second ends of the fixing pin, the guide projection having a latching step at an end of the guide projection proximal to the first end of the fixing pin, and each of the fixing holes distal to the weights having a guide groove corresponding to said guide projection and a groove corresponding to said latching projection;

a latching member provided in the internal cavity of the fixing unit, the latching member having a plurality of hooks, each of the hooks corresponding and positioned with reference to one of the sets of fixing pin holes, the hooks being configured so as to engage with the latching projection and limit movement of the fixing pin out of the insert hole after insertion of the fixing pin therein and to engage with the hooks on insertion so that the latch projection causes a longitudinal movement in the latch member which releases engagement of any other hook and corresponding latch projection;

a latch member spring arranged at the lower part of said latching member so as to bias the latching member toward the plate;

and a fixing pin spring for each fixing pin arranged so as to bias the fixing pin against engagement with the fixing pin's corresponding inset hole.

5. The variable load weight training machine of claim 4, further comprising solenoid switch for each of the fixing pins, the solenoid switch having a plunger portion positioned such that it will push the fixing pin into the corresponding insert hole when the solenoid switch is activated, and a control circuit electrically connected to the solenoid switches for actuating one of the solenoid switches based upon a users selection.

6. The variable load weight training machine of claim 4, further comprising a plurality of pulleys, each pulley corresponding to one of the fixing pins;

a plurality of cable wires, each cable wire being carried on one of the pulleys the pulley being braced in a position and the cable wire being connected at a first end to the pulley's corresponding fixing pin such that a pulling force on a second end of the cable wire causes the insertion of the corresponding fixing pin into the insert hole of the corresponding weight, and a control unit body;

a plurality of actuating bars, each actuating bar corresponding to one of the fixing pins, and connected to the second end of the cable wire having the first end connected to the corresponding fixing pin, each actuating bar movably mounted to the control unit body so as to translate a movement of the actuating bars along the connected cable wire into movement of the fixing pin in or out of the insert hole corresponding to the fixing pin.

7. The variable load weight training machine of claim 3, wherein the insert hole of each weight is provided under the center of gravity thereof.

8. The variable load weight training machine of claim 3, wherein the portion of each of the fixing pins that engages with the corresponding insert hole is a fixing plate portion, configured to follow the contours of an interior surface of the corresponding insert hole.

9. A variable load weight training machine, comprising a base;

a pair of weight guides having upper and lower ends, the lower ends of the weight guides being mounted to the base;

a plurality of weights slidably attached to the pair of weight guides such that the weights may slide between the upper and lower ends of the weight guides, the weight guides extending along an axis intersecting with an upper side and lower side of each of said weights, each of said weights having a corresponding lateral side extending from the upper side to the lower side of the weight, the lateral side of each weight having a recessed portion forming an indentation, the recessed portion extending from the upper side to the lower side of each weight, each of said weights having an insert hole formed in the recessed portion side;

a plate slidably attached to said weight guides such that the plate may slide to and fro between the upper and lower ends of the weight guides, the plate being closer to the upper ends of the weight guides than the plurality of weights, the plate having a lower side proximal to the plurality of weights;

a fixing unit extending in a longitudinal direction, defined by an axis that intersects the upper side and lower side of the weights, through the indentations of the weights when the lower side of the plate is in contact with the upper side of the weight closest to the upper ends of the weight guides, the fixing unit having a front plate extending along the longitudinal side of the fixing unit proximal to the insert holes in the weights, a rear plate extending along the longitudinal side of the fixing unit distal to the insert holes in the weights, a top plate extending between the front plate and rear plate along a side of the fixing unit proximal to the plate, a bottom plate extending between the front plate and rear plate along a side of the fixing unit distal to the plate, and side plates each extending along opposing sides of the fixing unit between the front, rear, top and bottom plates, the fixing unit mounted to the plate, the front plate having a plurality of fixing plate holes each corresponding to one of the weights and aligned with the insert hole of the corresponding weight when the lower side of the plate is in contact with the upper side of the weight closest to the upper ends of the weight guides; the rear plate having a plurality of push pin holes corresponding to the fixing plate holes, the plates forming an internal cavity;

a plurality of fixing plates provided in the internal cavity of said fixing unit each corresponding to one of the fixing plate holes, each of said fixing plates being sized positioned and configured so that an insert portion of the fixing plate may be inserted selectively into said insert hole of the weight corresponding to the fixing plate hole, a plurality of disengagement preventing plates one or more corresponding to each of the fixing plates moveably mounted in the fixing unit, each disengagement preventing plate being biased so as to impede the fixing plate from disengaging from the insert hole after insertion of the fixing plate into the insert hole.

10. The variable load weight training machine of claim 9, further comprising a plurality of guides, one for each of the disengagement preventing plates, each guide configured to direct the movement of the corresponding disengagement preventing plate, the guide having a stopping flange, the disengagement preventing plate having a stopper that engages with the stopping flange to limit the movement of the disengagement preventing plate.

11. The variable load weight training machine of claim 9, wherein the insert hole of each weight is provided under the center of gravity thereof.

12. The variable load weight training machine of claim 11, wherein the insert portion of each fixing plate is configured to follow thecontours of an interior surface of the corresponding insert hole.

13. The variable load weight training machine of claim 9, wherein the insert portion of each fixing plate is configured to follow the contours of an interior surface of the corresponding insert hole.

14. The variable load weight training machine of claim 9, further comprising a plurality of fixing pins, said fixing pins being formed with the same shape as said insert hole.

15. A variable load weight training machine comprising a base;

a weight guide mounted to the base;

one or more weights slidably attached to the weight guide, each of the weights having a fixing bar hole extending through the weight and an insert hole formed on an outer surface of the weight extending to the fixing bar hole; a plate slidably attached to the weight guide such that the one or more weights are positioned to a first side of the plate;

a fixing unit attached to the first side of the plate, the fixing unit having an internal cavity, the fixing unit having a plurality of fixing pin holes extending from an external surface of the fixing unit to the internal cavity, each of the fixing pin holes being part of a set of two fixing pin holes, each set of fixing pin holes corresponding to one of the weights, the fixing pin holes in each set of fixing pin holes being on opposing sides of the internal cavity and aligned with the insert hole of the corresponding weight;

a fixing pin slidably provided in each set of fixing pin holes so as to selectively engage and disengage a first end of the fixing pin proximal to the weights from the insert hole of the weight corresponding to the fixing pin hole set.

16. The variable load weight training machine according to claim 15, wherein the insert hole of each weight extends in a direction perpendicular to the weight guide to accommodate a fixing plate and the first end of each of the fixing pins that engages with the corresponding insert hole is configured as a fixing plate that follows the contours of an interior surface of the corresponding insert hole, the the variable load weight training machine further comprising a plurality of disengagement preventing plates one or more corresponding to each of the fixing plates moveably mounted in the fixing unit, each disengagement preventing plate being biased so as to impede the fixing plate from disengaging from the insert hole after insertion of the fixing plate into the insert hole.

17. A variable load weight training machine comprising a base;

a weight guide mounted to the base;

one or more weights slidably attached to the weight guide, each of the weights having a fixing bar hole extending through the weight and an insert hole formed on an outer surface of the weight extending to the fixing bar hole; a plate slidably attached to the weight guide such that the one or more weights are positioned to a first side of the plate;

a fixing bar with a plurality of holes formed therein, said fixing bar being mounted to the first side of the plate;

a fixing unit guide mounted to the first side of the plate, wherein the fixing unit guide is provided at the one side thereof with a plurality of stop grooves along its longitudinal direction, a fixing unit slidably attached to the fixing unit guide, said fixing unit having a receiving chamber passing therethrough that aligns with the insert hole of each weight as the fixing unit is slidably moved;

a fixing pin provided in the receiving chamber having a first end of the fixing pin distal to the weights and a second end proximal to the weights that is sized and positioned to be inserted into any one of the insert holes when the fixing unit receiving chamber is aligned with the one of the insert holes, the fixing pin being biased toward the insert hole.

* * * * *